US011647840B2

(12) United States Patent
Nelson et al.

(10) Patent No.: US 11,647,840 B2
(45) Date of Patent: May 16, 2023

(54) FURNITURE CONSOLE AND METHODS OF USING THE SAME

(71) Applicant: The Lovesac Company, Stamford, CT (US)

(72) Inventors: Shawn D. Nelson, Washington, UT (US); David M. Underwood, Hurricane, UT (US); Clint Gibson, St. George, UT (US); Jake Forman, Washington City, UT (US); Brian Kuchler, Hurricane, UT (US)

(73) Assignee: The Lovesac Company, Stamford, CT (US)

( * ) Notice: Subject to any disclaimer, the term of this patent is extended or adjusted under 35 U.S.C. 154(b) by 0 days.

(21) Appl. No.: 17/349,363

(22) Filed: Jun. 16, 2021

(65) Prior Publication Data

US 2022/0400868 A1 Dec. 22, 2022

(51) Int. Cl.
*A47C 7/72* (2006.01)
*A47C 7/62* (2006.01)

(52) U.S. Cl.
CPC ..... *A47C 7/725* (2013.01); *A47C 7/624* (2018.08)

(58) Field of Classification Search
CPC .. A47C 7/725; A47C 7/72; A47C 7/62; A47C 7/624; A47C 7/74; A47C 7/748
USPC ..... 297/440.21
See application file for complete search history.

(56) References Cited

U.S. PATENT DOCUMENTS 988,059 A 3/1911 Allen
2,625,983 A 1/1953 Raymond et al.
2,653,648 A 9/1953 Marshall
3,113,633 A 12/1963 Eberhardt et al.
3,870,297 A 3/1975 Elder
3,880,152 A 4/1975 Nohmura
3,893,731 A 7/1975 Maggs
4,120,017 A 10/1978 Sickles
4,124,249 A 11/1978 Abbeloos
(Continued)

FOREIGN PATENT DOCUMENTS

CN 2236262 Y 10/1996
CN 101005741 A 7/2007
(Continued)

OTHER PUBLICATIONS

"Curry, M. ""Its Speakers Sound Good Even in Terrible Listening Environments, i.e. Your Apartment;"" Core77; Article [online]. Sep. 29, 2015 [retrieved Jan. 30, 2017]. Retrieved from the Internet: <URL: http://www.core77.com/posts/41080/Sonos-Debuts-Software-That-Makes-lts-Speakers-Sound-Good-Even-in-Terrible-Listening-Environments-ie-Your-Apartment; p. 2, paragraph 2 to p. 4, paragraph 1".

(Continued)

*Primary Examiner* — Mark R Wendell
(74) *Attorney, Agent, or Firm* — Workman Nydegger

(57) ABSTRACT

A furniture console having a base and at least one of a lighting device selectively mounted to the base, a first charging device supported by the base, a thermal energy transfer assembly configured to heat or cool a first container selectively mounted to the base, and an electricity storage assembly mounted within the base, the electricity storage assembly being configured to power the furniture console. A control assembly configured to control operation of the at least one of the lighting device, the first charging device, and the thermal energy transfer assembly.

22 Claims, 26 Drawing Sheets

(56) References Cited

U.S. PATENT DOCUMENTS 4,321,717 A 3/1982 Serra
4,507,816 A 4/1985 Smith, Jr.
4,734,946 A 4/1988 Saputo
4,846,525 A 7/1989 Manning
5,106,153 A 4/1992 Durling
5,173,943 A 12/1992 Dzurko
5,362,296 A 11/1994 Wang et al.
5,367,727 A 11/1994 Dyer, Jr.
5,368,359 A 11/1994 Eakin
5,544,938 A 8/1996 Saul et al.
5,624,156 A 4/1997 Leal et al.
5,681,179 A 10/1997 Lane
5,683,139 A 11/1997 Golynsky et al.
5,735,573 A 4/1998 Vredevoogd
5,790,993 A 8/1998 Roma et al.
5,828,766 A 10/1998 Gallo
5,895,365 A 4/1999 Tomlinson
5,967,820 A 10/1999 Siegal et al.
5,995,634 A 11/1999 Zwolski
6,000,353 A 12/1999 De Leu
6,000,758 A 12/1999 Schaffner et al.
6,073,723 A 6/2000 Gallo
6,092,867 A 7/2000 Miller
6,322,146 B1 11/2001 Fisher, Jr.
6,814,709 B2 11/2004 Schwartz et al.
7,003,832 B2 2/2006 Wilson
7,090,297 B2 8/2006 Mohn et al.
7,172,196 B2 2/2007 Randall
7,213,885 B2 5/2007 White et al.
D547,087 S 7/2007 Natuzzi
7,312,393 B2 12/2007 McCarthy
7,419,220 B2 9/2008 White et al.
7,421,608 B2 9/2008 Schron
7,547,073 B2 6/2009 White et al.
7,553,288 B2 6/2009 Cohen
7,575,279 B2 8/2009 Robertson
7,631,937 B2 12/2009 Robertson
7,699,389 B2 4/2010 Robertson
7,735,912 B2 6/2010 Robertson
7,766,421 B2 8/2010 Lawson
7,871,280 B2 1/2011 Henriott
7,918,308 B2 4/2011 Cohen
7,963,612 B2 6/2011 Nelson
7,982,436 B2 7/2011 Randall
8,061,864 B2 11/2011 Metcalf et al.
8,074,581 B2 12/2011 Epstein et al.
8,132,856 B2 3/2012 Wilson et al.
8,146,229 B2 4/2012 Henriott et al.
8,228,026 B2 7/2012 Johnson et al.
8,421,407 B2 4/2013 Johnson
8,668,045 B2 3/2014 Cohen
8,783,778 B2 7/2014 Nelson et al.
8,920,191 B2 12/2014 Carpanzano
8,935,985 B2 1/2015 Hjelm
9,010,851 B2 4/2015 LaPointe
9,088,117 B2 7/2015 Rosenblum
9,095,209 B2 8/2015 Mirth et al.
9,119,000 B2 8/2015 Tracy
9,124,308 B2 9/2015 Metcalf
9,185,988 B1 11/2015 Sanchez
9,277,826 B2 3/2016 Nelson et al.
9,295,339 B2 3/2016 Hampton
9,529,431 B2 12/2016 Bleacher et al.
9,585,468 B2 3/2017 Udagawa et al.
9,788,092 B2 10/2017 Rawls-Meehan et al.
9,853,405 B2 12/2017 Suri
9,984,686 B1 5/2018 Mutagi et al.
10,212,519 B2 2/2019 Nelson et al.
10,235,643 B2 3/2019 Sawka
10,236,643 B2 3/2019 Nelson et al.
10,972,838 B2 4/2021 Nelson et al.
10,979,241 B2 4/2021 Nelson et al.
11,159,026 B2 10/2021 Kim
11,172,301 B2 11/2021 Nelson et al.
11,178,486 B2 11/2021 Nelson et al.
11,178,487 B2 11/2021 Nelson et al.
11,374,417 B2 6/2022 Bober et al.
11,381,091 B2 7/2022 Fang et al.
11,435,534 B2 9/2022 Hill et al.
11,444,485 B2 9/2022 Partovi
2001/0020810 A1 9/2001 Kennedy
2002/0063454 A1 5/2002 Khosro
2003/0025366 A1 2/2003 Armando
2003/0102657 A1 6/2003 Kuo
2003/0139693 A1 7/2003 Swift
2004/0026998 A1 2/2004 Henriott et al.
2004/0061943 A1 4/2004 Bosch et al.
2004/0095000 A1 5/2004 Durling
2005/0007067 A1 1/2005 Baarman et al.
2005/0008147 A1 1/2005 Lee
2005/0053252 A1 3/2005 Cohen
2005/0096098 A1 5/2005 Woods
2005/0185801 A1 8/2005 McCarty et al.
2005/0264044 A1 12/2005 Lee
2006/0036201 A1 2/2006 Cohen
2006/0076813 A1 4/2006 Mohn et al.
2006/0238087 A1 10/2006 Holt
2006/0279124 A1 12/2006 White et al.
2007/0001494 A1 1/2007 Hoover
2007/0164178 A1 7/2007 Beilstein et al.
2008/0012404 A1 1/2008 Dewert
2008/0037794 A1 2/2008 Sugawara et al.
2008/0122241 A1 5/2008 Blackmore et al.
2008/0150329 A1 6/2008 Lawson
2008/0220646 A1 9/2008 Leddusire
2008/0262657 A1 10/2008 Howell et al.
2009/0001775 A1 1/2009 Smith
2009/0032660 A1 2/2009 Wadsworth et al.
2009/0072782 A1 3/2009 Randall
2009/0096255 A1 4/2009 Robertson
2009/0212638 A1 8/2009 Johnson
2009/0212639 A1 8/2009 Johnson
2009/0212737 A1 8/2009 Johnson et al.
2009/0250982 A1 10/2009 Cohen
2010/0055928 A1 3/2010 Randall
2010/0178797 A1 7/2010 Byrne
2010/0290215 A1 11/2010 Metcalf et al.
2010/0320819 A1 12/2010 Cohen et al.
2011/0012403 A1 1/2011 Wilson et al.
2011/0025915 A1 2/2011 Daban
2011/0109163 A1 5/2011 Bennett
2011/0109211 A1 5/2011 Kirkeby et al.
2011/0110075 A1 5/2011 Smith
2011/0298340 A1 12/2011 Nelson et al.
2012/0026724 A1 2/2012 Metcalf et al.
2012/0051579 A1 3/2012 Cohen
2012/0200129 A1 8/2012 Wilson, Jr.
2012/0286557 A1 11/2012 Hoffman et al.
2012/0316884 A1 12/2012 Rozaieski et al.
2013/0002001 A1 1/2013 Allen et al.
2013/0066636 A1 3/2013 Singhal
2013/0137524 A1 5/2013 Scott
2013/0177198 A1 7/2013 Hogue et al.
2013/0199421 A1 8/2013 Hjelm
2013/0207478 A1 8/2013 Metcalf et al.
2013/0234481 A1 9/2013 Johnson
2013/0249257 A1 9/2013 Suhre et al.
2013/0333940 A1 12/2013 Stencil
2014/0010387 A1 1/2014 Cohen
2014/0197666 A1 7/2014 Koch
2014/0272266 A1 9/2014 Svilar
2014/0285140 A1 9/2014 Jung
2014/0368476 A1 12/2014 Rauch et al.
2015/0061258 A1 3/2015 Flores et al.
2015/0069965 A1 3/2015 Verschueren
2015/0076881 A1 3/2015 LaPointe
2015/0076891 A1 3/2015 LaPointe et al.
2015/0230622 A1 8/2015 George
2015/0255914 A1 9/2015 Kong et al.
2015/0300627 A1 10/2015 Wang et al.
2015/0334482 A1 11/2015 Rawls-Meehan et al.
2016/0126916 A1 5/2016 Kappus et al.
2016/0136529 A1 5/2016 Weston et al.
2016/0174715 A1 6/2016 Nelson et al.

(56) References Cited

U.S. PATENT DOCUMENTS

| | | | | |
|---|---|---|---|---|
| 2016/0379631 | A1 | 12/2016 | Wang et al. | |
| 2017/0135490 | A1* | 5/2017 | Andrix | A47C 31/008 |
| 2017/0149181 | A1 | 5/2017 | Nelson et al. | |
| 2017/0150264 | A1 | 5/2017 | Nelson et al. | |
| 2017/0214197 | A1 | 7/2017 | Suri | |
| 2017/0221340 | A1 | 8/2017 | Rhoads, Jr. et al. | |
| 2017/0295941 | A1 | 10/2017 | King et al. | |
| 2017/0317458 | A1 | 11/2017 | Byrne et al. | |
| 2018/0041354 | A1 | 2/2018 | Nelson et al. | |
| 2018/0158192 | A1 | 6/2018 | Rocque et al. | |
| 2018/0253947 | A1 | 9/2018 | Muhsin et al. | |
| 2019/0222935 | A1 | 7/2019 | Nelson et al. | |
| 2020/0100030 | A1 | 3/2020 | Nelson et al. | |
| 2020/0100031 | A1 | 3/2020 | Nelson et al. | |
| 2020/0221227 | A1 | 7/2020 | Nelson et al. | |
| 2021/0002170 | A1* | 1/2021 | Chien | C03B 27/012 |
| 2021/0112341 | A1 | 4/2021 | Nelson et al. | |
| 2021/0352422 | A1 | 11/2021 | Lin et al. | |
| 2022/0060829 | A1 | 2/2022 | Nelson et al. | |
| 2022/0078555 | A1 | 3/2022 | Nelson et al. | |
| 2022/0095060 | A1 | 3/2022 | Yang et al. | |
| 2022/0115907 | A1* | 4/2022 | Bober | A47C 21/003 |
| 2022/0337928 | A1 | 10/2022 | Nelson et al. | |

FOREIGN PATENT DOCUMENTS

| | | | |
|---|---|---|---|
| CN | 201135239 | Y | 10/2008 |
| CN | 201178847 | Y | 1/2009 |
| CN | 201282826 | Y | 8/2009 |
| CN | 201341645 | Y | 11/2009 |
| CN | 201452358 | U | 5/2010 |
| CN | 201518894 | U | 7/2010 |
| CN | 101909490 | A | 12/2010 |
| CN | 202211357 | U | 5/2012 |
| CN | 202553058 | U | 11/2012 |
| CN | 202817641 | U | 3/2013 |
| CN | 202907151 | U | 4/2013 |
| CN | 202981088 | U | 6/2013 |
| CN | 203563950 | U | 4/2014 |
| CN | 203609079 | U | 5/2014 |
| DE | 102012211865 | A1 | 5/2013 |
| EP | 3376897 | A1 | 9/2018 |
| EP | 3376904 | A1 | 9/2018 |
| GB | 2300329 | A | 10/1996 |
| JP | 47-004753 | Y1 | 2/1972 |
| JP | 56-087863 | A | 7/1981 |
| JP | 59-067079 | A | 4/1984 |
| JP | 59-107523 | A | 6/1984 |
| JP | 06-079086 | A | 3/1994 |
| JP | 3047023 | U | 3/1998 |
| JP | 2001-285976 | A | 10/2001 |
| JP | 2004-097273 | A | 4/2004 |
| JP | 2007-003994 | A | 1/2007 |
| JP | 2008-513138 | A | 5/2008 |
| JP | 2008-545504 | A | 12/2008 |
| JP | 2013-094405 | A | 5/2013 |
| JP | 2014-230026 | A | 12/2014 |
| JP | 2015-126460 | A | 7/2015 |
| WO | 99/63786 | A1 | 12/1999 |
| WO | 2006/135509 | A2 | 12/2006 |
| WO | 2009/113319 | A1 | 9/2009 |
| WO | 2012/093398 | A2 | 7/2012 |
| WO | 2014/072975 | A1 | 5/2014 |
| WO | 2016/044884 | A1 | 3/2016 |
| WO | 2017/087266 | A1 | 5/2017 |
| WO | 2017/087268 | A1 | 5/2017 |
| WO | 2021/141783 | A1 | 7/2021 |

OTHER PUBLICATIONS

"The Wireless Speaker and Audio (WISA®) Association," retrieved Nov. 7, 2016 at www.wisaassocation.org, 2 pages (considered).
"WISA Wireless Speaker & Audio," retrieved on Nov. 7, 2016 at www.wisaassociation.org, 3 pages (considered).
Bose Corporation, http://en.wikipedia.org/wiki/Bose_Corporation, Apr. 25, 2012.
Equalization (audio) Wikipedia, web.archive.org archived pages, https://web.archive.org/web/20210325042554/https://en.wikipedia.org/wiki/Equalization_(audio) dated Mar. 25, 2021, last updated Mar. 20, 2021 (11 pages).
Equalization (audio); Wikipedia, https://en.wikipedia.org/wiki/Equalization_(audio), printed Jul. 13, 2021 (11 pages).
Equalization—What's the difference of frequency sets for 10 band equalizers?—Sound Design Stock Exchange; sound.stackechange.com question/answer website pages; dated Jan. 22, 2015 (2 pages).
Final Office Action dated May 22, 2019 from U.S. Appl. No. 15/786,922, filed Oct. 18, 2017.
Final Office Action received for U.S. Appl. No. 13/869,600, dated Sep. 14, 2016.
Final Office Action received for U.S. Appl. No. 15/270,339, dated Mar. 12, 2018.
Final Office Action received for U.S. Appl. No. 15/348,068, dated Apr. 2, 2018.
Final Office Action received for U.S. Appl. No. 16/273,773, dated Feb. 12, 2020.
Final Office Action received for U.S. Appl. No. 16/273,773, dated Oct. 13, 2020.
Final Rejection dated May 3, 2021 for U.S. Appl. No. 16/696,696.
Final Rejection dated May 24, 2021 for U.S. Appl. No. 16/738,916.
Issue Notification received for U.S. Appl. No. 15/270,339, dated Feb. 27, 2019.
Issue Notification received for U.S. Appl. No. 15/348,068, dated Jan. 30, 2019.
Issue Notification received for U.S. Appl. No. 15/786,922, dated Aug. 5, 2020.
Leviton, "2-Gang White Duplex Outlet/Quick Port Plate Recessed Device," retrieved Nov. 17, 2017 at homedepot.com, (2 pages) (considered).
Leviton, "Product Bulletin for Recessed Devices Cat. Nos. 689 and 690," Copyright 2008, published and available, on information and belief, at least as early as 2008 (2 pages), (considered).
NOA received for U.S. Appl. No. 15/270,339, dated Jan. 24, 2019.
NOA received for U.S. Appl. No. 15/348,068, dated Dec. 12, 2018.
Non-Final Rejection dated Apr. 19, 2021 for U.S. Appl. No. 16/273,773.
Notice of Allowance and Fees Due (PTOL-85) dated Jul. 27, 2021 for U.S. Appl. No. 16/273,773.
Notice of Allowance dated Aug. 27, 2020 from U.S. Appl. No. 16/696,712, filed Nov. 26, 2019.
Notice of Allowance for U.S. Appl. No. 15/786,922, dated Mar. 2, 2020.
Notice of Allowance received for U.S. Appl. No. 15/786,922, dated Jul. 10, 2020.
Notice of Allowance received for U.S. Appl. No. 15/786,922, dated Sep. 15, 2020.
Notice of Allowance received for U.S. Appl. No. 15/786,922, dated Sep. 23, 2020.
Notice of Allowance received for U.S. Appl. No. 15/786,922, dated Sep. 28, 2020, 2 pages.
Notice of Allowance received for U.S. Appl. No. 16/696,712, dated Dec. 30, 2020.
Office Action from United States U.S. Appl. No. 13/869,600, dated Dec. 15, 2015 (9 pages).
Office Action received for U.S. Appl. No. 15/270,339, dated Aug. 6, 2018.
Office Action received for U.S. Appl. No. 15/270,339, dated Jun. 22, 2017.
Office Action received for U.S. Appl. No. 15/348,068, dated Nov. 1, 2017.
Office Action received for U.S. Appl. No. 15/348,068, dated Oct. 2, 2018.
Office Action received for U.S. Appl. No. 15/786,922, dated Nov. 28, 2018.
Office Action received for U.S. Appl. No. 15/786,922, dated Oct. 1, 2019.
Office Action received for U.S. Appl. No. 16/273,773, dated Jun. 16, 2020.

(56) References Cited

OTHER PUBLICATIONS

Office Action received for U.S. Appl. No. 16/273,773, dated Oct. 25, 2019.
Office Action received for U.S. Appl. No. 16/696,696, dated Jan. 14, 2021.
Office Action received for U.S. Appl. No. 16/738,916, dated Jan. 28, 2021.
Restriction Requirement received for U.S. Appl. No. 15/348,068, dated Aug. 2, 2017.
The Wall Street Journal newspaper article entitled, "Wireless Charging Everywhere," dated Dec. 30, 2015.
U.S. Appl. No. 60/778,761, entitled Power Delivery Surface Power Supply Safety, dated Mar. 3, 2006 (59 pages).
Sobro Coffee Table with Built in Fridge, Speakers, Outlets, LED Light, and More—Black, 12 pages, www.amazon.com Nov. 29, 2022.
Sobro Smart Side/Nightstand Table—with Cooling Drawer, Wireless Charging, Bluetooth Speakers, USB-C and 120V outlets, LED Light, Black/Black, 11 pages, www.amazon.com, Nov. 29, 2022.
Black Sobro Smart End Table with Built-in-Outlets, 7 pages, www.wayfair.com, Nov. 30, 2022.
Jason Cartwright, This connected bed has wireless charging, bluetooth and a subwoofer, 8 pages, Aug. 12, 2019, www.techau.com.au, Nov. 28, 2022.
Notice of Allowance received in U.S. Appl. No. 16/696,696, dated Sep. 21, 2021.
Notice of Allowance received in U.S. Appl. No. 16/738,916, dated Sep. 28, 2021.
Office Action received in U.S. Appl. No. 17/348,088, dated Jul. 26, 2022.
Office Action received in U.S. Appl. No. 17/128,575, dated Oct. 24, 2022.
Notice of Allowance received in U.S. Appl. No. 17/348,088, dated Dec. 19, 2022.

* cited by examiner

FURNITURE CONSOLE AND METHODS OF USING THE SAME

CROSS-REFERENCE TO RELATED APPLICATIONS

NA

BACKGROUND

A variety of shapes and sizes of furniture have been developed over the years to provide comfort and decoration. Consumers appreciate furniture that can serve multiple purposes and withstand the wear of everyday use without requiring much attention. Thus, what is desirable is furniture that is versatile, durable, and relatively maintenance free.

Once purchased, consumers expect furniture that is already assembled or can be easily assembled. Once assembled, however, most furniture cannot be easily disassembled. Most furniture is assembled using nails, staples, epoxy, or some other type of fastener. Further, various types of furniture have upholstery covering the fasteners, thus making it difficult to disassemble the furniture. This presents a challenge for consumers, especially when the furniture needs to be transported from one location to another. While some modular furniture systems are available, many of these require tools for assembly, are often not particularly durable, and exhibit other shortcomings.

One aspect that makes furniture cost-prohibitive is shipping and packaging. For example, a large piece of furniture requires an even larger amount of space during shipping. The non-solid or non-uniform shape of most furniture makes it difficult to maximize the space utilized when packaging and shipping furniture. This adds increased costs of shipping due to the amount of space the furniture requires, regardless of whether or not the furniture fills all or most of the required space.

Another aspect that makes furniture cost-prohibitive is the difficulty in stacking furniture. When large pieces of furniture are stacked, damage frequently occurs to the furniture on the bottom of the stack. This damage may result from the shape and non-solid nature of the packaged furniture. Even when furniture is disassembled and boxed in order to facilitate stacking, often there is still much wasted space. The wasted space not only increases the cost of shipping, but also provides for a less stable base on which to stack other pieces of furniture.

For those consumers who cannot afford many pieces of furniture, it is also desirable to have furniture which can provide multiple functions, or which can be reconfigured. For example, a couch with a relatively deep and soft seating surface can be desirable when lounging, watching television, or listening to music. In contrast, a couch with a relatively shallow seating surface is often more desirable when sitting upright while in conversation with others. Further, different shapes, sizes, and footprint configurations of furniture may be desired depending on the space which the furniture is to fill, such as a large living room, a small office space, or a home theatre setting.

While modularity of furniture provides multiple functions to users, modularity and multi-function of components usable with modular furniture is unavailable. For instance, since individuals typically use modular furniture when lounging, watching television, listening to music, or while in conversation with other, it would improve an individual's experience performing those activities to declutter the furniture or surrounding area with other devices that the individual might use while being seated or otherwise using the furniture.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments of the present disclosure solve one or more of the forgoing or other problems in the art with systems, methods, and apparatuses for providing access to one or more different functionalities that a user may wish to use while resting or otherwise being seated upon or near modular furniture. In particular, the systems, methods, and apparatuses provide a furniture console including a base and at least one of: a lighting device selectively mounted to the base, a first charging device supported by the base, and a thermal energy transfer assembly configured to heat or cool a first container selectively mounted to the base. The furniture console also includes an electricity storage assembly mounted within the base, the electricity storage assembly being configured to power the furniture console, a control assembly configured to control operation of the at least one of the lighting device, the first charging device, and the thermal energy transfer assembly. The furniture console can optionally include at least one air flow path extending through at least a portion of base to direct air past the thermal energy transfer assembly to aid with transfer of energy between the thermal energy transfer assembly and the air.

In another configuration, the systems, methods, and apparatuses provide a furniture console including a base having a first leg portion, a second leg portion, and an intermediate portion, and at least one of: a lighting device selectively mounted to the base; a first charging device supported by the base; a thermal energy transfer assembly cooperating with a recess of the base, the thermal energy transfer assembly being configured to heat or cool a first container selectively mounted within at least a portion of the recess; a virtual assistant; and a battery mounted within at least one of the first leg portion and the intermediate portion, the battery being configured to power the furniture console. The furniture console also includes a control assembly configured to control operation of the at least one of the lighting device, the first charging device, and the thermal energy transfer assembly. Optionally, at least one air flow path extends through at least a portion of one or more of the first leg portion, the second leg portion, and the intermediate portion to direct air past the thermal energy transfer assembly to aid with transfer of energy between the thermal energy transfer assembly and the air.

In another configuration, the systems, methods, and apparatuses provide a furniture system having a first furniture assembly comprising a seat portion, and arm portion, and a back portion; and a furniture console selectively mounted to the first furniture assembly, the furniture console being selectively mounted to one of the arm portion and the back portion. The furniture console can control the operation of the first furniture assembly and/or other components, devices, or apparatuses associated with the first furniture assembly, such as remote audio and/or video components or structures, computers, or other devices. The furniture system can also include a container usable with the furniture console, such as a container having an outer wall, an insulative layer, an inner wall forming an interior liquid chamber, and a heating assembly configured to heat the inner wall and liquid disposed in the interior liquid chamber. The heating assembly can include at least one receiver coil of an inductive charger.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which:

FIGS. 81 and 8J are partial perspective views illustrating a folding lighting device for a furniture console.

DETAILED DESCRIPTION

Figure 1:
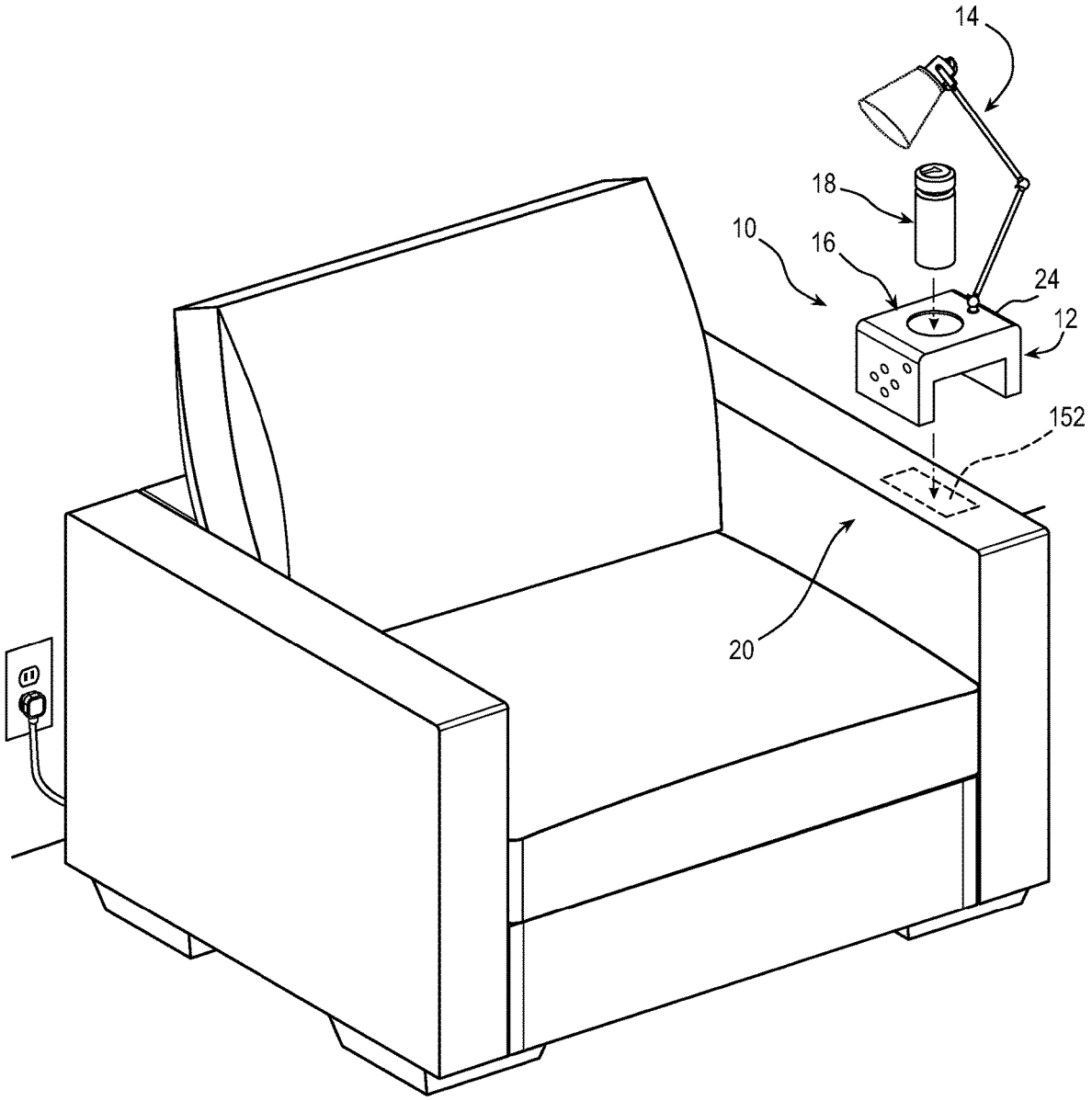
FIG. 1 illustrates a perspective view illustrating a furniture console cooperating with a furniture assembly and a container.

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to apparatuses, methods, and systems for providing a furniture console that provides an individual with various capabilities, such as one or more of charging electronic devices, heating/cooling containers, improving lighting conditions, accessing information via an internet connection, providing control of connected devices, interfacing with a virtual assistant, and providing other capabilities. The apparatuses, methods, and systems provide convenient access to a variety of embedded technologies in a seamless manner to improve user experiences with those technologies, and when the furniture console is positioned on a surface, such as a piece of furniture, with the piece of furniture. The apparatuses, methods, and systems are used to improve an individual's experience performing activities with or without a furniture system or assembly. The apparatuses, methods, and systems use various mechanical, electromechanical, electrical, hardware and/or software components, systems, and modules to improve an individual's experience, such as experiences performed when lounging, watching television, listening to music, while in conversation with others, or performing or participating in other activities.

While the present disclosure will describe particular implementations of apparatuses, methods, and systems, it should be understood that the apparatuses, methods, and systems described herein may be applicable to other uses. Additionally, elements described in relation to any embodiments depicted and/or described herein may be combinable with elements described in relation to any other embodiment depicted and/or described herein.

The disclosed embodiments bring about substantial benefits, improvements, and practical implementations to the technical field. By way of example and not limitation, the improved structure of the furniture console provides for convenient access to a variety of embedded technologies in a seamless manner to improve user experiences with those technologies, and when the furniture console is positioned on a surface, such as a piece of furniture, with the piece of furniture. Integrating various technologies into a single furniture console, apparatus, or system allows for simple user specific positioning in relation to a surface, for example, while accommodating numerous individual needs simultaneously. This leads to decreased user expenses to obtain desired functionality, while providing increased functionality in a more compact form factor, at a reduced cost, thereby leading to substantial improvements in the technical field. These and numerous other benefits will now be discussed in more detail with regard to the Figures presented by this disclosure.

Some example improvements and practical applications are provided by the disclosed embodiments. It will be appreciated, however, that these are just examples only and that the embodiments are not limited to only these improvements. Generally, now referring to the drawings in detail wherein like reference numerals are used to designate like elements, there is shown one or more embodiments of the present disclosure that provides apparatuses, methods, and systems.

Figure 2:
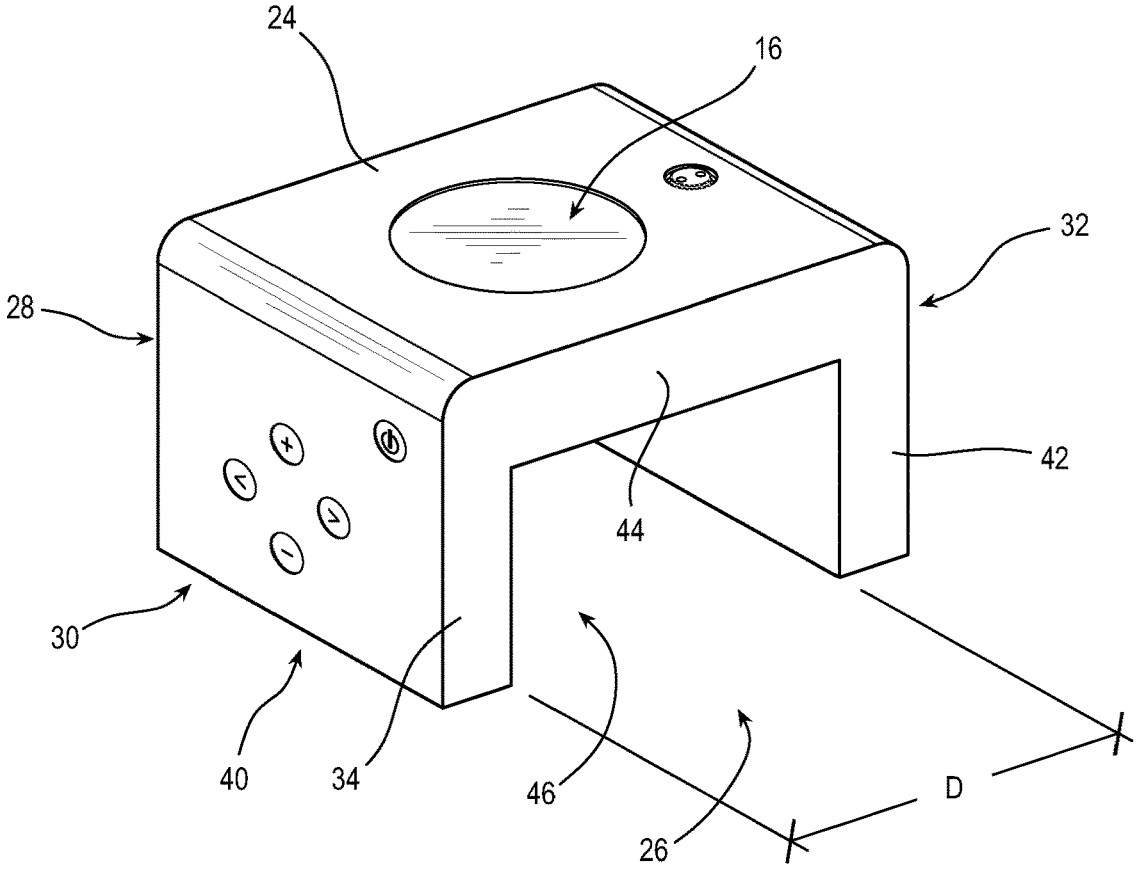
FIG. 2 illustrates a perspective view of a portion of a furniture console.

FIGS. 1 and 2 illustrate a furniture console 10 that can be used alone or in combination with some other structure, such as a furniture assembly 20 as will be described in more detail hereinafter. The furniture console 10 includes a base 12 having a lighting device 14 and a thermal energy transfer assembly 16. The base 12 can be used to position the furniture console 10 as needed by the user, such as on an arm or back of a single seat or multiple seat piece of furniture assembly 20, a table, a storage product, a floor, or any other surface which is deemed desirable by the user, these being considered as a furniture assembly. The base 12 provides a stable structure for resting a container 18 to be heated or cooled by the thermal energy transfer assembly 16 and for extending the lighting device 14 without overturning the base 12, whether or not the base 12 is removably mounted to, for example, an arm or back of a single seat or multiple seat piece of furniture. The base 12 can have sufficient mass to prevent overturning of the base 12 when the lighting device 14 extends from an upper surface 24 or from a front 26, a back 28, a first side 30, and/or a second side 32 of the base 12. The base 12 also provides a stable structure for resting the container 18 so as to be heated or cooled by the thermal energy transfer assembly 16. An outer facia of the base 12 can be formed of a variety of materials and can optionally be selectively removable to change the look and feel of the furniture console 10 in relation to the surrounding décor. For instance, the outer facia can be formed of wood, polymer, ceramic, composite, fabrics, natural materials, combinations and/or modifications thereof. The outer facia can be removably attached through clips, fasteners, hook and loop fasteners, snap-fit fasteners, adhesives or other bonding materials, combinations and modifications thereof, or other structures that allow releasable mounting of the outer facia to a remainder of the base 12.

As illustrated in FIGS. 1 and 2, the base 12 has a first leg portion 40 and a second leg portion 42 with an intermediate portion 44 extending between the first leg portion 40 and the second leg portion 42. The first leg portion 40 and the second leg portion 42 are separated by a distance D to provide a recess or cavity 46 that can receive a portion of an arm or back of a single seat or multiple seat piece of furniture as will be described hereinafter. The first leg portion 40 and the second leg portion 42 extend generally perpendicularly from the intermediate portion 44; however, in other configurations, the first leg portion 40 and the second leg portion 42 can be inclined in relation to the intermediate portion 44. For instance, an angle between the first leg portion 40 and the intermediate portion 44 can range from about 45 degrees to about 135 degrees, from about 60 degrees to about 100 degrees, from about 30 degrees to about 120 degrees, from about 75 degrees to about 90 degrees, or other angular orientations that aid with positioning a structure, such as an arm or back of a single seat or multiple seat piece of furniture within the cavity 46.

Figure 3A:
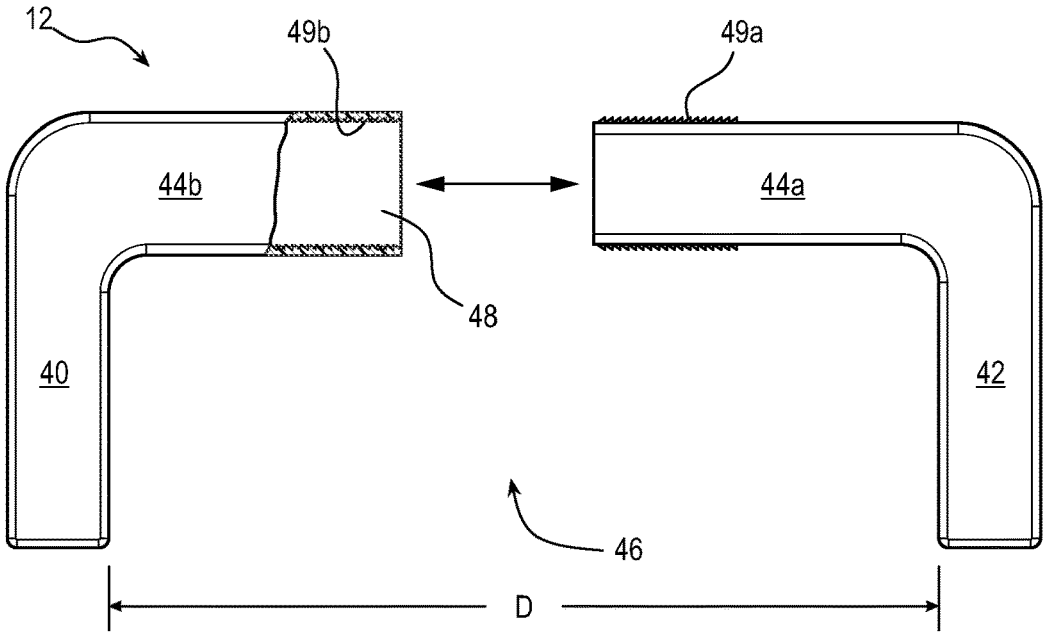
FIG. 3A-3C illustrated partial cross-sectional views of alternate furniture consoles.
Figure 3B:
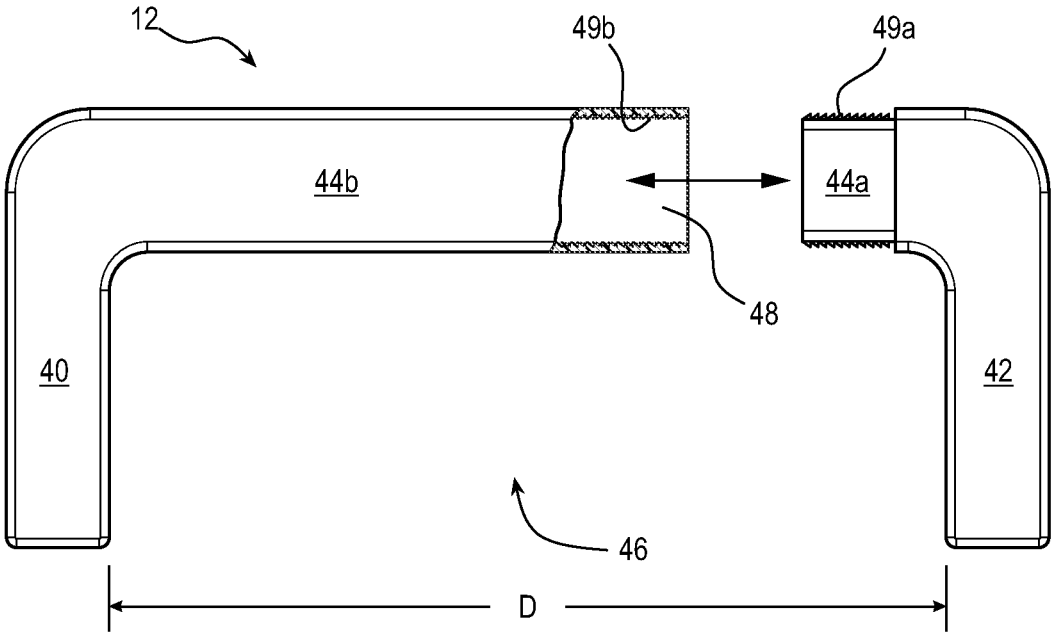

While the recess 46 has a fixed dimension in the illustrated configuration of FIGS. 1 and 2, it is understood that dimensions of the recess 46 can be changed, such as selectively changed to accommodate different structures to which the base 12 is disposed or positioned upon. For instance, one or more of the first leg portion 40, second leg portion 42, and intermediate portion 44 can include telescoping components to allow increasing and decreasing in one or more of width, depth, length, and height. For instance, as illustrated in FIGS. 3A and 3B, a first intermediate portion 44*a* of the intermediate portion 44 can be slidable received within an intermediate telescoping recess 48 of the second intermediate portion 44*b* of the intermediate portion 44, with FIG. 3B illustrating that the intermediate telescoping recess 48 is formed to a side of the thermal energy transfer assembly 16. The first intermediate portion 44*a* can include detents, grooves, pins, stops, fingers, catches, retainers, or other structures 49*a* that cooperate with complementary structures 49*b* within the intermediate telescoping recess 48 to provide a friction or mechanical interference connection that limits movement of the first intermediate portion 44*a* in relation to the intermediate telescoping recess 48.

Figure 3C:
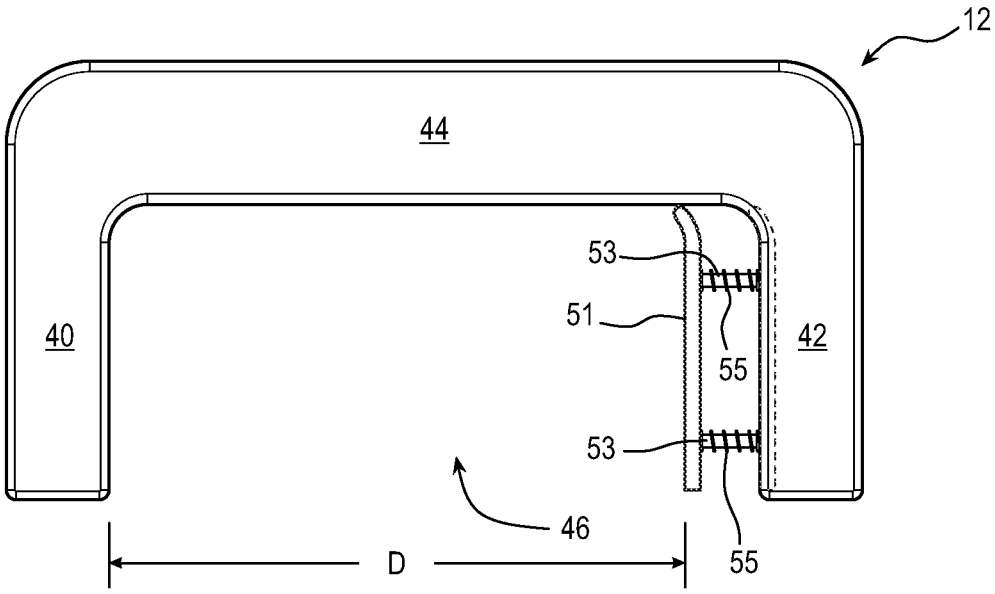

FIG. 3C illustrates another configuration in which the recess 46 can be changed to accommodate or receive a portion of the furniture assembly 20. As illustrated in FIG. 3C, an adjustable member or plate 51 disposed within the recess 46. The adjustable member or plate 51 is support by the second leg portion 42 by connecting member 53. The connecting members 53 allows slidable movement of the adjustable member or plate 51 in relation to the second leg portion 42 under the influence of a biasing member 55, such as a spring, a resilient member, an elastic member, hydraulic or pneumatic assembly, mechanical biasing member/assembly, an electromechanical biasing member/assembly, bellows, combinations and modifications thereof, or other structure that can apply a biasing force to the adjustable member or plate 51. For instance, the biasing member 55 applies a biasing force to the adjustable member or plate 51 to move it away from the second leg portion 42. The outward force applied by the biasing member 55 allows the adjustable member or plate 51 to apply a force to the furniture assembly 20 to aid with retaining the furniture console 10 on the furniture assembly 20. While the biasing member 55 is illustrated disposed around the connecting members 53, it will be understood by those skilled in the art that the biasing member 55 can be disposed within the base 12 of the furniture console 10, such as within the first leg portion 40, the second leg portion 42, or some other portion. Additionally, while the adjustable member or plate 51 is mounted to the second leg portion 40, in alternate configurations the adjustable member or plate 51 could be supported by the first leg portion 40, or each of the first leg portion 40 and the second leg portion 42 can include the adjustable member or plate 51.

Figure 4:
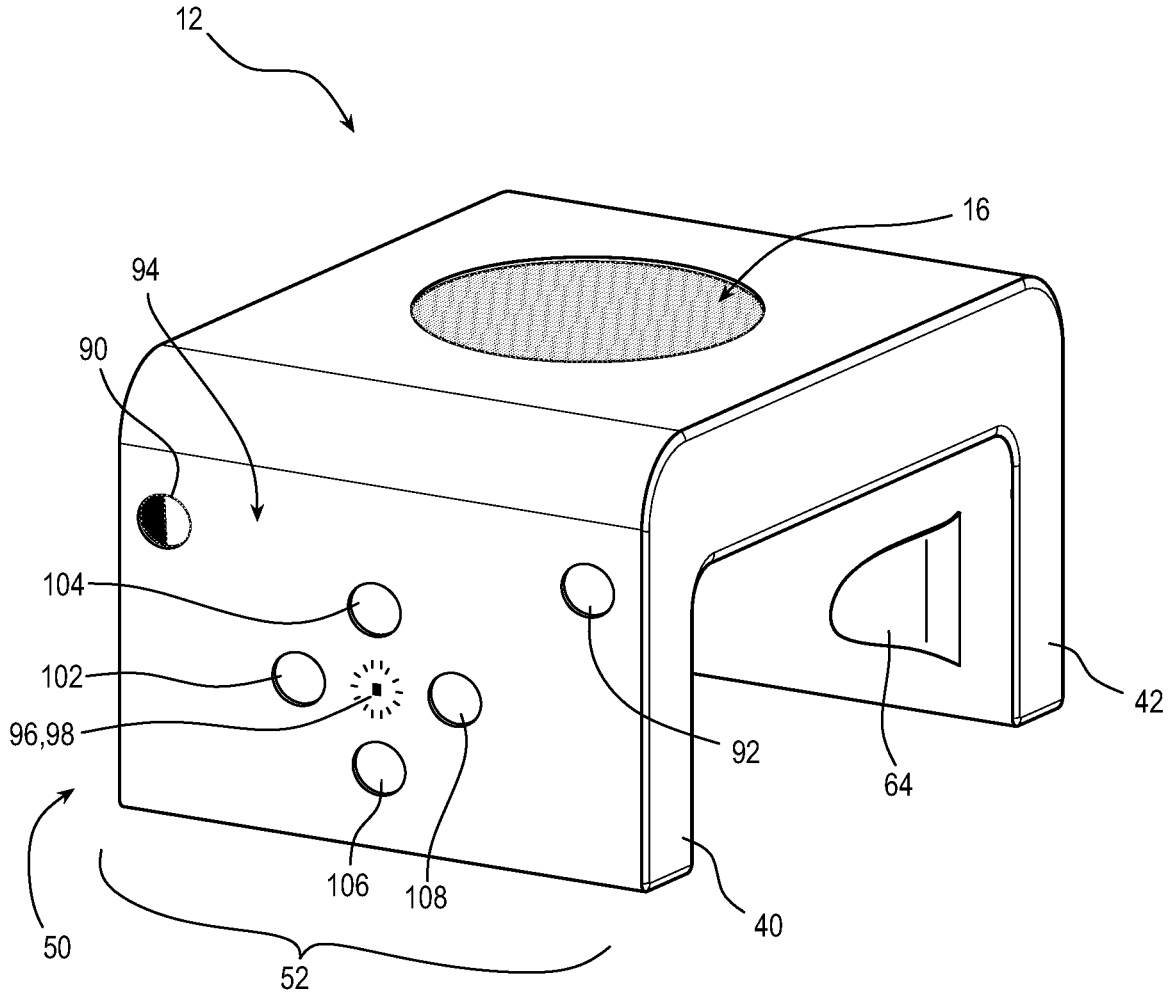
FIG. 4 illustrates a partial cutaway perspective view of a portion of the furniture console.

Turning to FIG. 4, the first leg portion 40 includes a control assembly 50 associated with a control region 52. The control assembly 50, and the control region 52, can include various buttons, switches, actuators, controllers, etc. to allow a user to operate the various functions of the furniture console 10, including operation of the lighting device 14 (FIG. 1) and the thermal energy transfer assembly 16, for instance. While a majority of the controls are illustrated being within the control region 52, it will be understood that in other configurations the controls can be dispersed over other portions of the base 12. Additionally, portions of the control assembly 50 can be retained within the base 12, such as processors, memory, storage, and other components that will be discussed hereinafter.

As illustrated in FIG. 4, the second leg portion 42 includes a power supply or an electricity storage assembly 64, such as a battery, used to power the furniture console 10 when it is not connected to mains power or is not receiving power through the furniture assembly 20, as will be described hereinafter. For instance, when the furniture console 10 is not connected to mains power or some other power source, such as the furniture assembly 20, the electricity storage assembly 64 can power the lighting device 14 (FIG. 1), the thermal energy transfer assembly 16, and other components of the furniture console 10. The electricity storage assembly 64 can include a single battery (whether rechargeable and/or replaceable), a plurality of batteries (whether rechargeable and/or replaceable), one or more batteries having a single or multi cell structure battery (whether rechargeable or replaceable), combinations and modifications thereof. In one configuration, the electricity storage assembly 64 can include a battery having a capacity from about 1,000 mAh to about 100,000 mAh, less than about 100, 000 mAh, greater than about 1,000 mAh, or about 25,000±10,000 mAh. The particular configuration of the electricity storage assembly 64 can also aid with preventing overturning of the base 12 by providing additional mass or weight to the base 12.

Figure 5A:
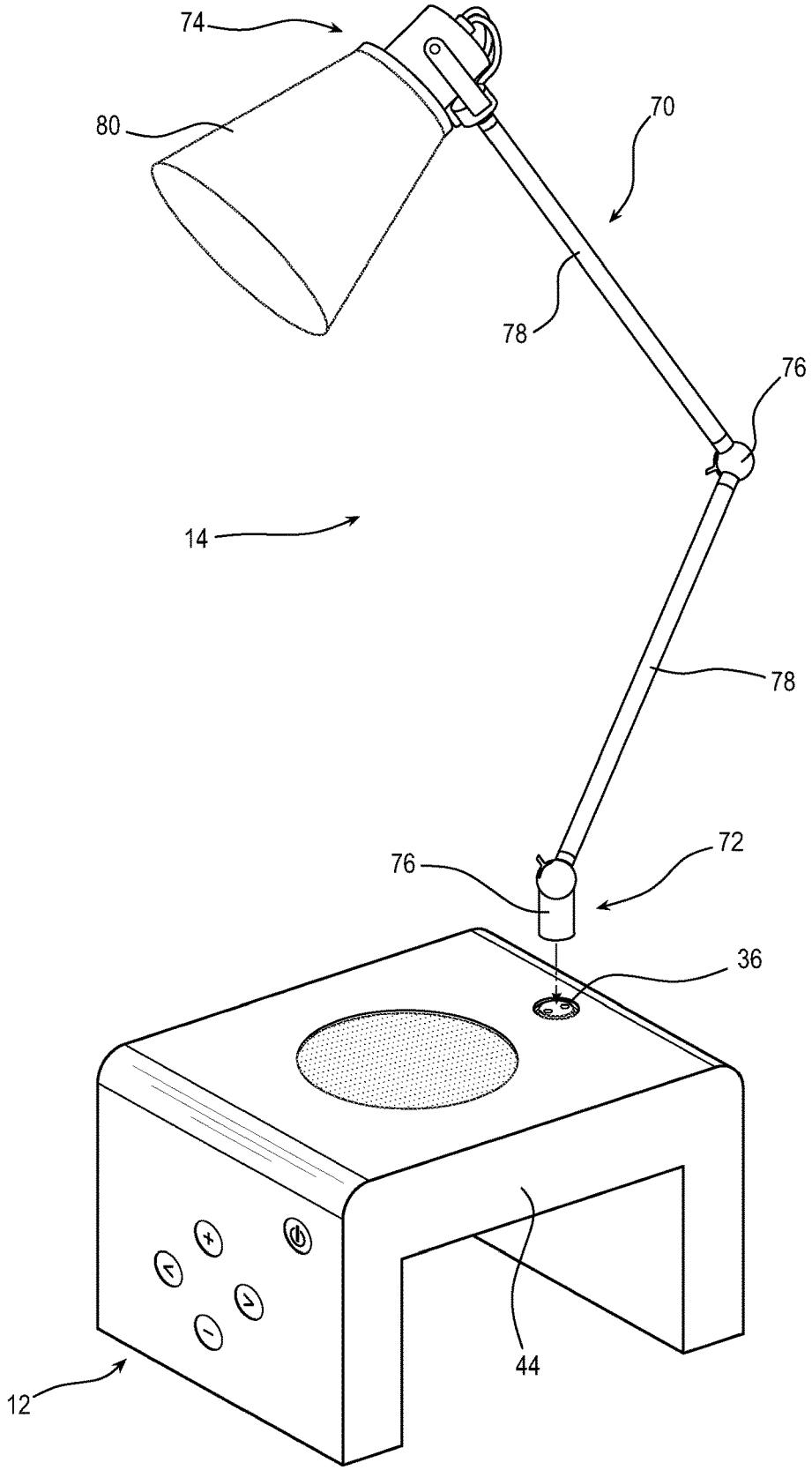
FIG. 5A is an exploded view illustrating a lighting device separate from a base of a furniture console.
Figure 5B:
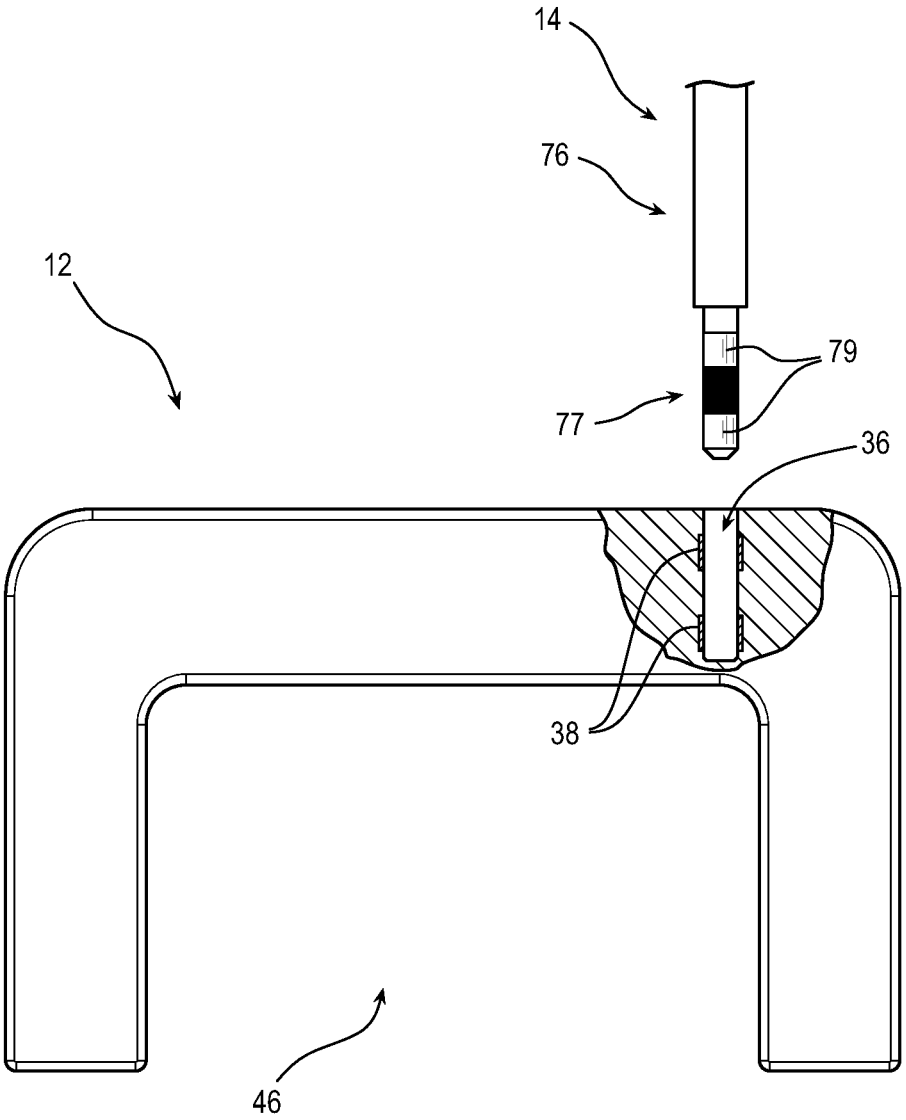
FIG. 5B is a cross-sectional view illustrating a connection of the lighting device with the base.

With reference to FIGS. 5A and 5B, the intermediate portion 44 includes a receiving port 36 to receive or cooperate with the lighting device 14, such as a lamp, when the base 12 is to be used with the lighting device 14. For instance, the lighting device 14 has a shaft 70 with a first end 72 that can be received within the receiving port 36 directly or by way a light coupler 76 disposed between a shaft segment 78 and the receiving port 36 to allow for one or more of swivelling, rotating, turning, tilting, sliding, or otherwise positioning of the shaft 70, and so a remainder of the lighting device 14, in relation to the intermediate portion 44. State another way, the lighting device 14 and/or the intermediate portion 44 includes the light coupler 76 to allow for one or more of swivelling, rotating, turning, tilting, sliding, or otherwise positioning of a second end 74 of the lighting device 14 in relation to the base 12 and so the surface on which the base 12 is disposed. This allows the user to position a light source 80, such as light bulb, light emitting diode (LED), or other light source, in a desired position based upon the particular activity the user is engaged in, such as reading, writing, conversing with others, etc. As illustrated in FIG. 5A, the lighting device 14 includes two light couplers, with one light coupler 76 being positioned intermediate the first end 72 and the second end 74. The light coupler 76 can be received within the receiving port 36. A connector end 77 can be received within the receiving port 36 so that electrical contacts 79 can cooperate with electrical contacts 38 within the receiving port 36 thereby electrically connecting the lighting device 14 with the base 12. The receiving port 36 is illustrated as a through-hole so that liquid or fluids can pass through the receiving port 36 to prevent possible water damage to the electrical contacts 38 and 79 in the event liquid falls on the base 12. Although through-hole is illustrated, it will be understood that in other configurations the receiving port 36 can have one closed end, such as toward the recess 46.

Figure 6:
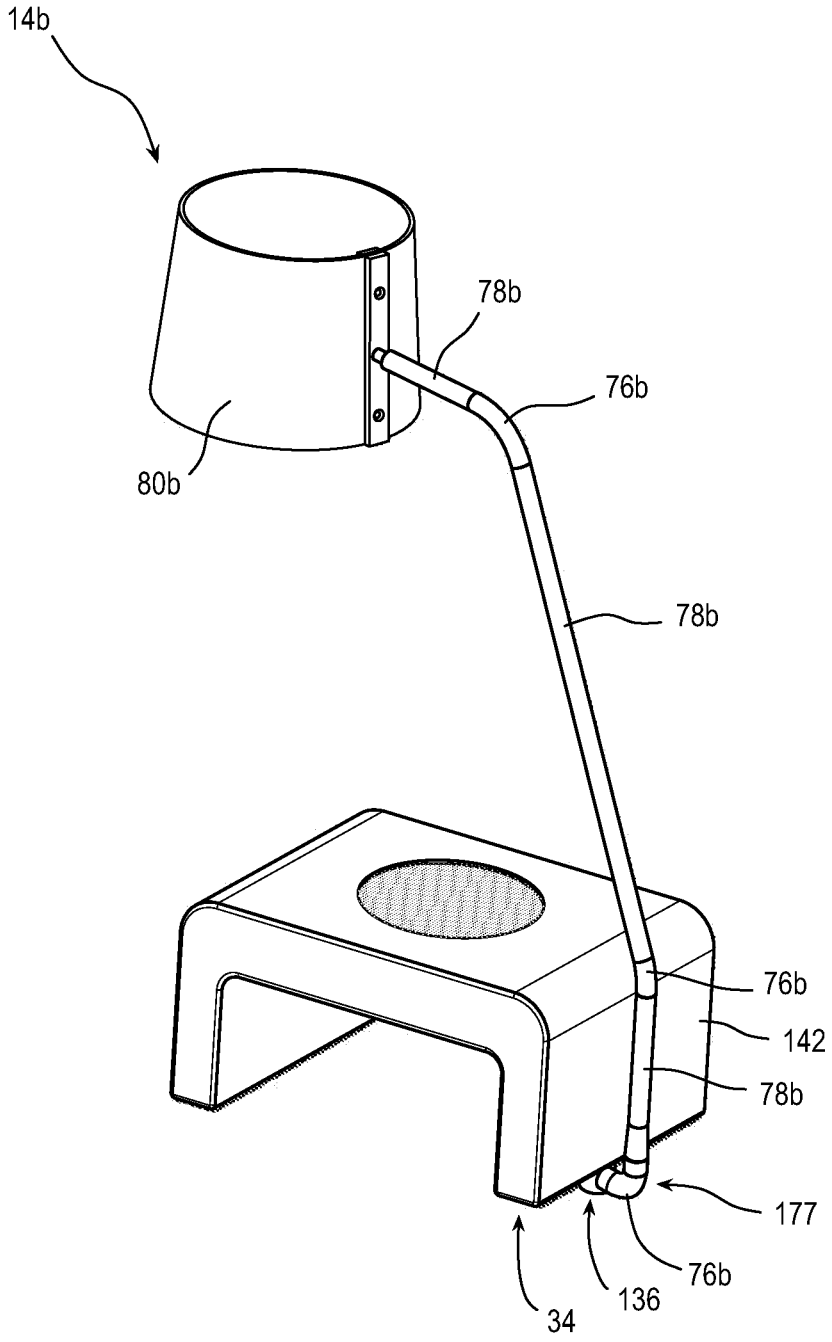
FIG. 6 is a perspective view of a furniture console with alternate lighting device for a furniture console.
Figure 7:
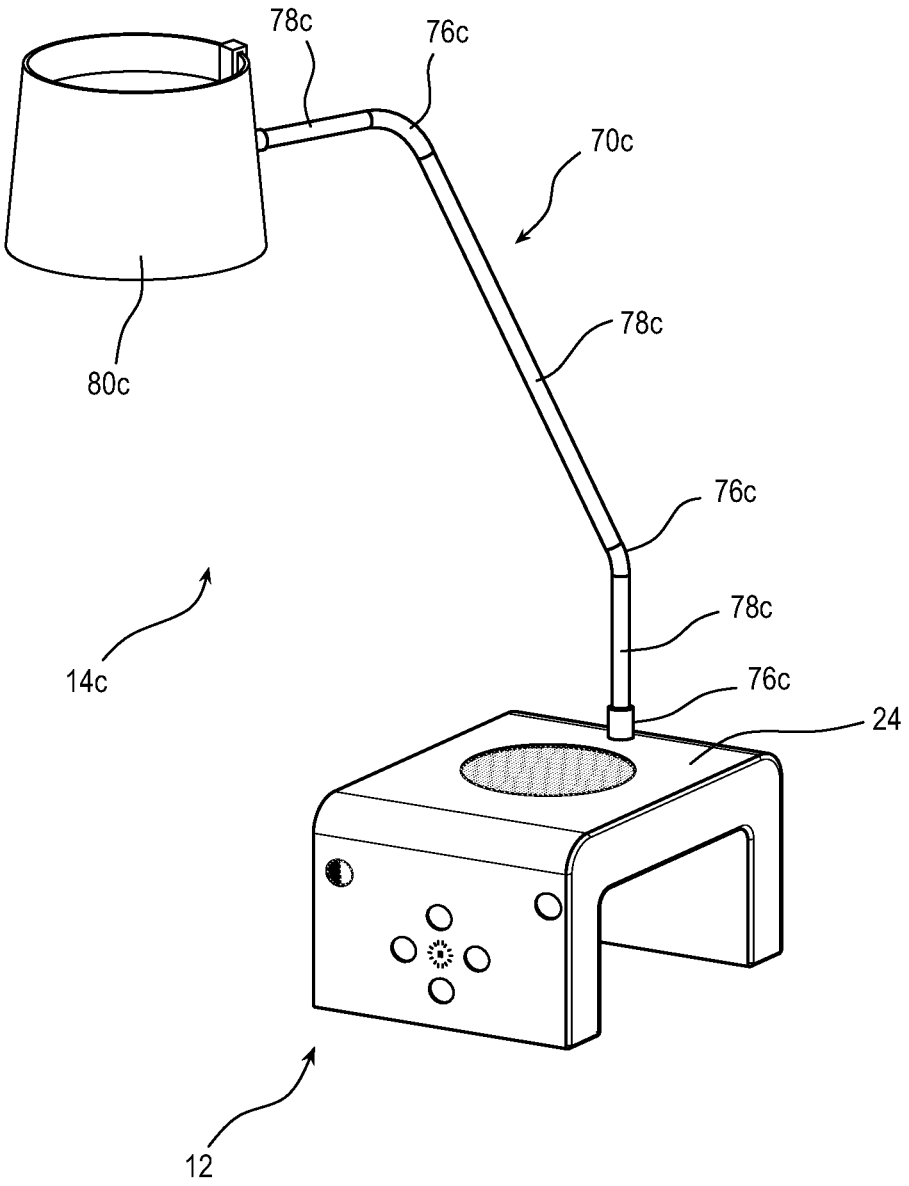
FIG. 7 is a perspective view of a furniture console with alternate lighting device for a furniture console.

While the configuration of FIGS. 1 and 5A-5B illustrates the lighting device 14 extending from the upper surface 24 of the base 12, it will be understood that the lighting device 14 can extend from other portions of the base 12, such as but not limited to one or more of the front 26, the back 28, the first side 30, the second side 32, or the bottom surface 34 of the base 12, with the front 26, the back 28, the first side 30, the second side 32, or the bottom surface 34 having the receiving port 36. For instance, as illustrated in FIG. 6, the receiving port 136 can be disposed in a bottom surface 134 of the second leg portion 142. FIG. 6 illustrates an alternate lighting device 14*b* that includes one or more light couplers 76*b* and has an alternate light source 80*b* with a different shade and light source bulb, etc. FIG. 7 illustrates a modified version of the lighting device 14*b* of FIG. 6 in which lighting device 14*c* mounts to a receiving port, such as the receiving port 36 in FIG. 5B, on the upper surface 24 of the base 12 in a similar manner to the lighting source 14 of FIGS. 5A and 5B, such as illustrated in FIG. 7.

Figure 8A:
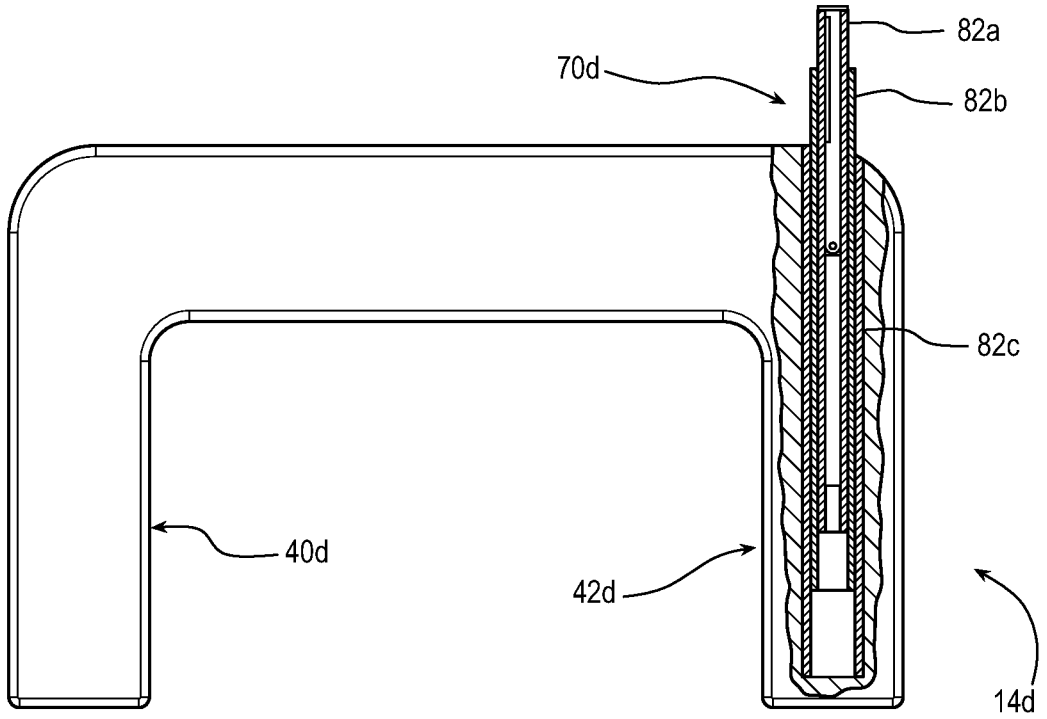
FIG. 8A is a partial cross-sectional view illustrating a telescoping lighting device for a furniture console.

As mentioned above, the lighting device can have various configurations and mount to the base in various alternate manners. For instance, the lighting devices 14, 14*b*, and 14*c* include lighting couplers 76, 76*b*, 76*c*, it will be understood that in other configurations the lighting devices can include one or more lighting couplers. For instance, a single lighting coupler can connect the shaft to the base, while a remainder of the shaft is a single or multi-piece shaft having a predefined shape. FIGS. 8A-8N illustrate various other lighting devices.

Figure 8B:
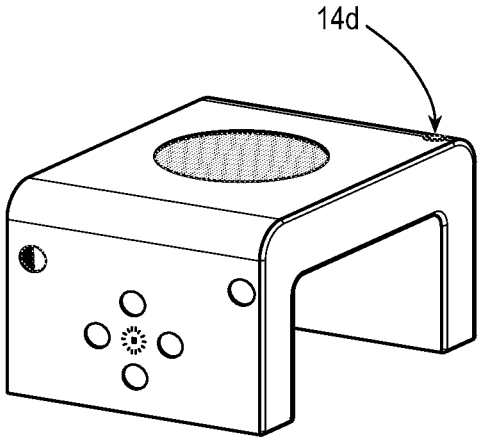
FIGS. 8B and 8C are partial perspective views illustrating a telescoping lighting device for a furniture console.
Figure 8C:
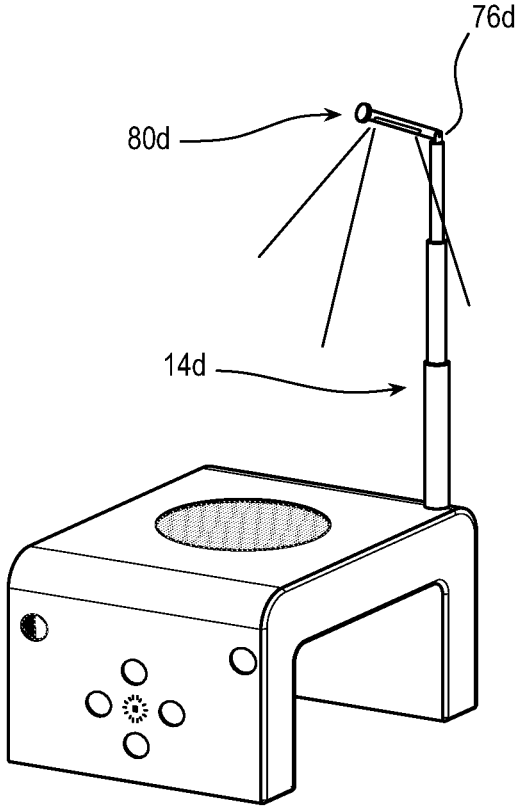

Turning to FIGS. 8A-8C, the lighting device 14*d* can selectively telescope and can be collapsed and received within the second leg portion 42*d*, and a portion of the intermediate portion 44*d*, such as illustrated in FIG. 8B. A shaft 70*d* of the lighting device 14*d* is disposed in the second leg portion 42*d* and includes a first shaft portion 82*a*, a second shaft portion 82*b*, and a third shaft portion 82*c*, that can be slide relative to one another to position a light source (not shown) as desired by a user. The first shaft portion 82*a* cooperates with a light coupler 76*d* to position the light source 80*d*, such as a reading light emitting diode. The light couplers 76*d* of the lighting device 14*d* can have an outside diameter or other cross-sectional dimension that allows disposition of the light couplers 76*d* within a lumen or channel of, respectively, one or more of the first shaft portion 82*a*, the second shaft portion 82*b*, and/or the third shaft portion 82*c*.

Figure 8D:
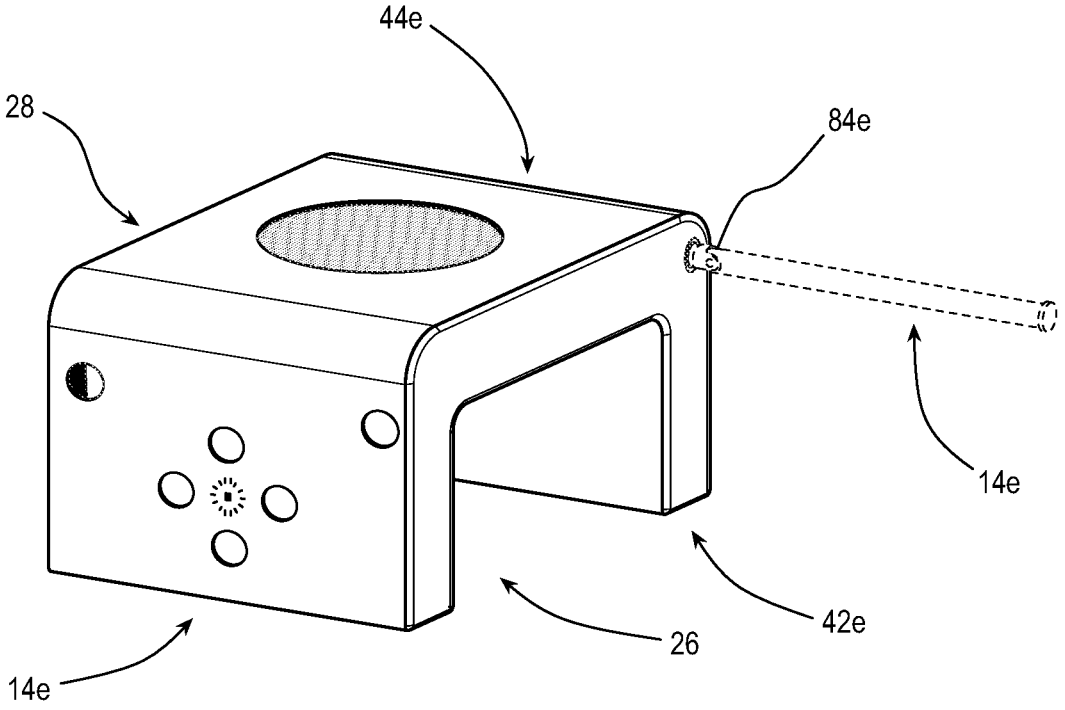
FIG. 8D is a perspective view illustrating a channel for receiving a lighting device for a furniture console.
Figure 8E:
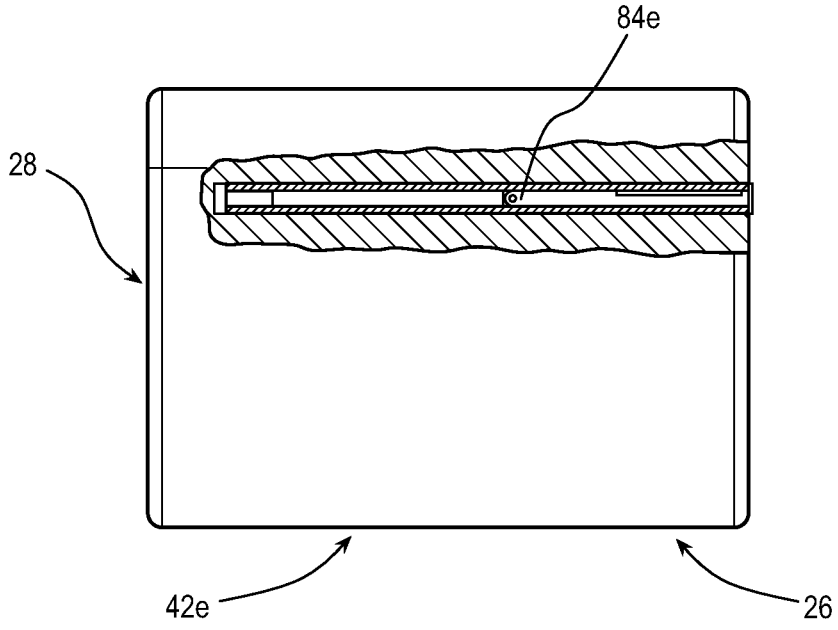
FIGS. 8E-8H are cross-sectional view illustrating channels for receiving a lighting device for a furniture console.
Figure 8F:
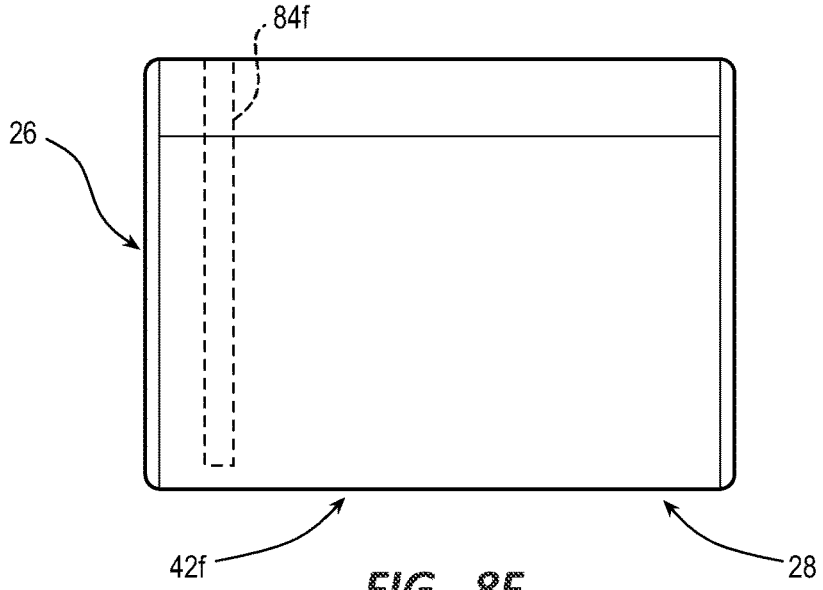
Figure 8G:
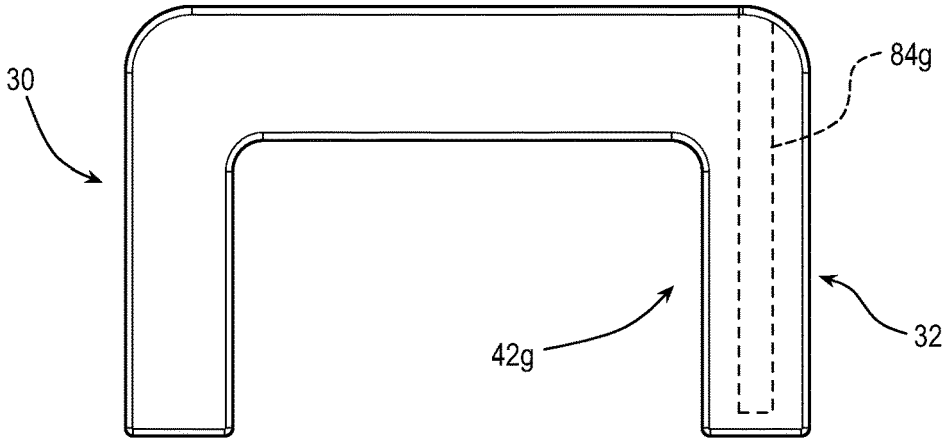
Figure 8H:
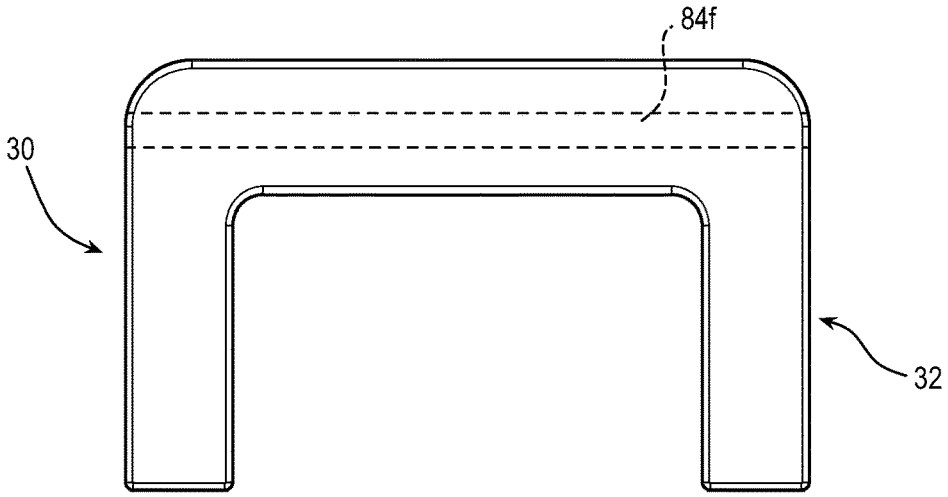

In still another configuration, as illustrated in FIGS. 8D and 8E, a lighting device 14*e* (illustrated in phantom), which can be any of the lighting devices described herein, can collapse or otherwise be reduced in length so as to be received in a complementary recess 84*e* that extends from the front 26 to the back 28 along the second leg portion 42*e* and/or a portion of the intermediate portion 44*e*. Alternatively, as illustrated in FIGS. 8F-8H, the lighting devices described can be received within a recess 84*f* extending in a height direction of the second leg portion 42*f*, such as on the second side 32 of the second leg portion 42*f* illustrated in FIG. 8F, within a recess 84*g* on a front 26 of the second leg portion 42*g*, as illustrated in FIG. 8G, or within a recess 84*h* formed in a portion of the intermediate portion 44*h*, as illustrated in FIG. 8H. More generally, it will be also understood that the complementary recess that receives a lighting device can be formed in one or more of the first leg portion, the second leg portion, the intermediate portion or combinations of any of the leg portions and the intermediate portion of the base of the furniture console.

Figure 8I:
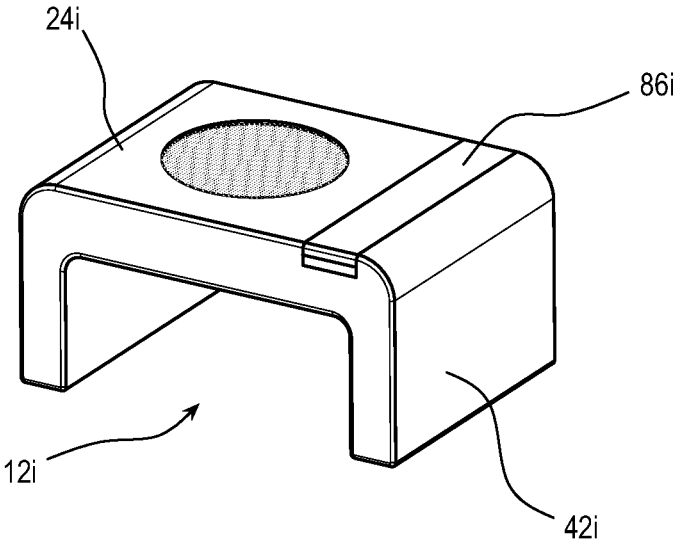
Figure 8J:
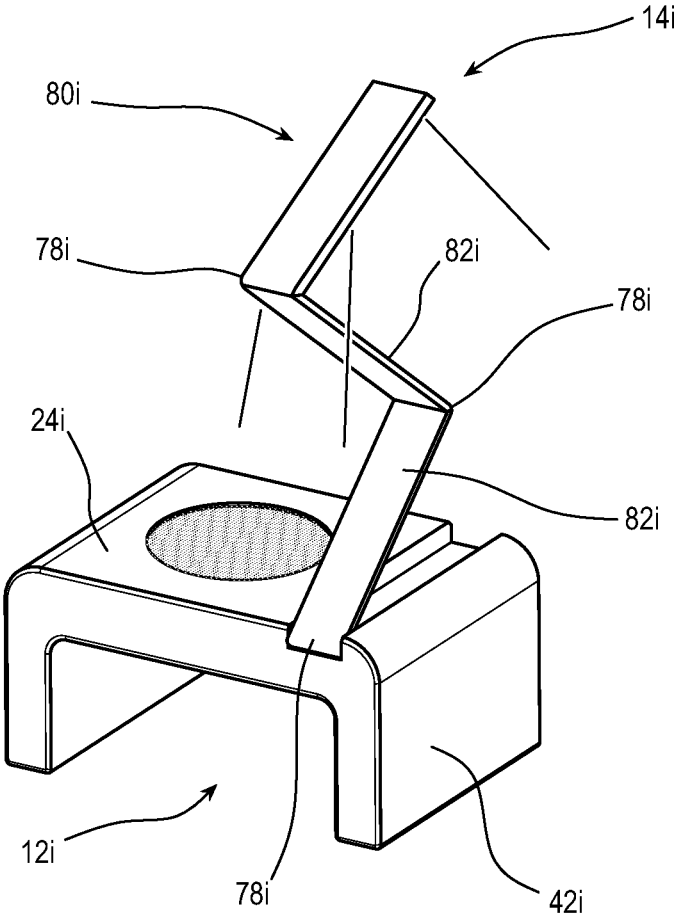
Figure 8K:
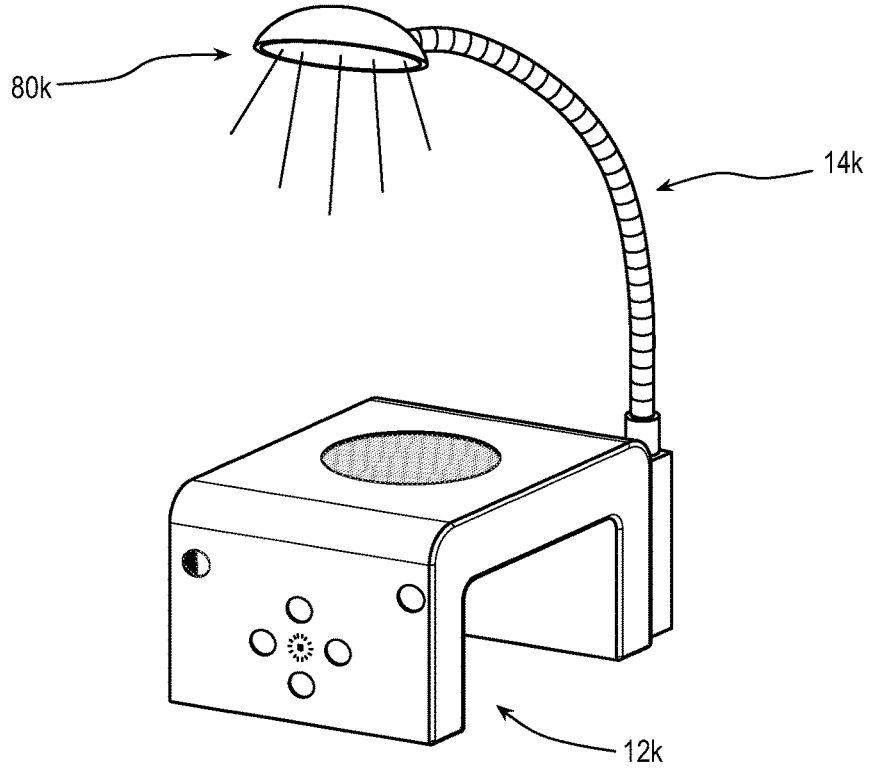
FIG. 8K is a perspective view illustrating a detachable lighting device for a furniture console.
Figure 8L:
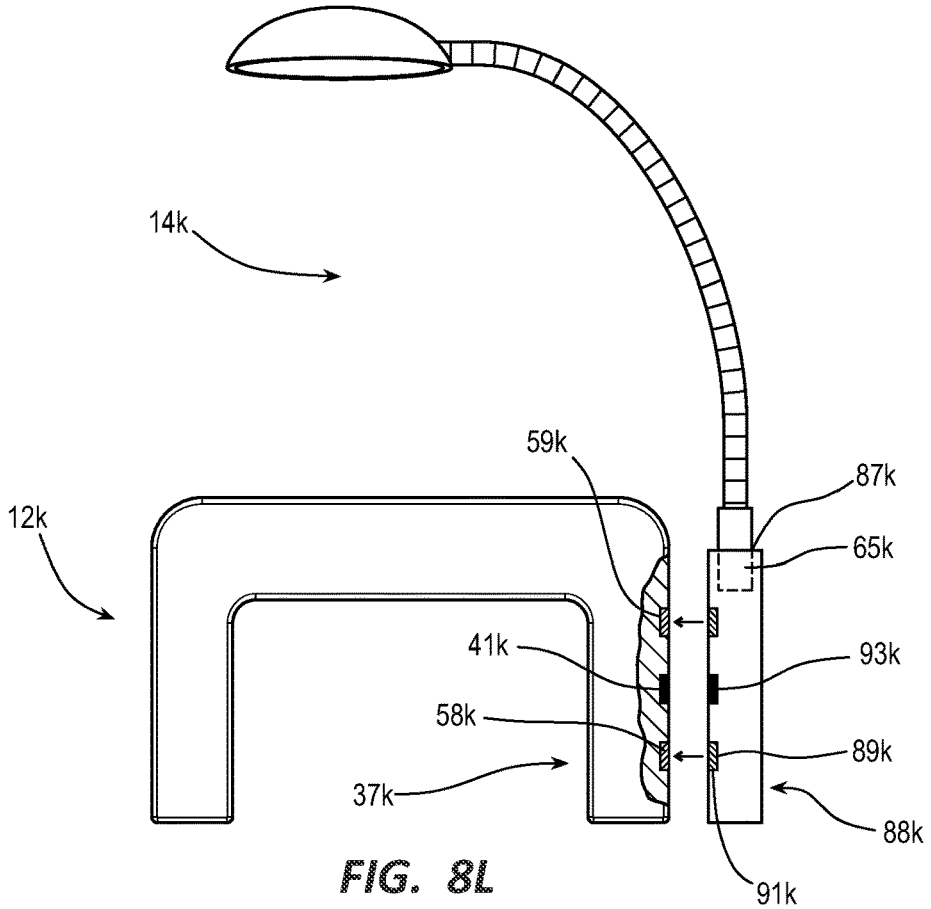
FIG. 8L is a partial cross-sectional view illustrating a detachable lighting device for a furniture console.
Figure 8M:
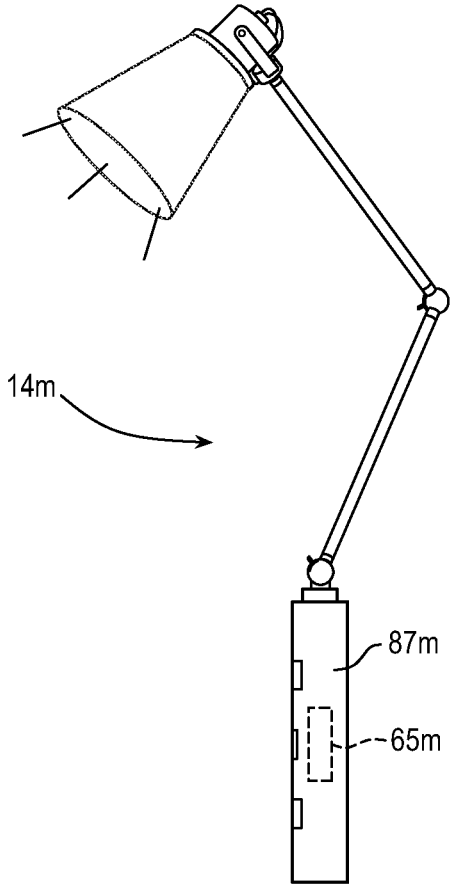
FIGS. 8M and 8N are perspective views illustrating different lighting devices that detachable couple to a base of a furniture console.
Figure 8N:
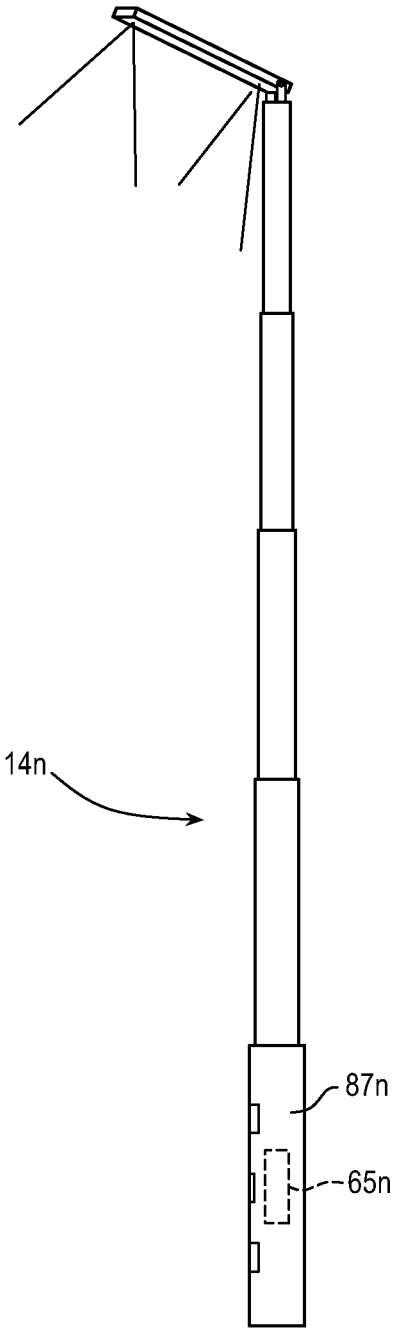

In still another configuration, as illustrated in FIGS. 8I-8J, the lighting device 14*i* includes a folding member 70*i* having segments 78*i* that fold together into the collapsed configuration illustrated in FIG. 8J. The light source 80*i* not only provides illumination for a user, but in the collapsed configuration, an outer surface 86*i* of the light source 80*i* forms the outer surface of the base 12*i* as it approximates a curvature of the upper surface 24*i* and/or portions of one of the leg portions, such as the second leg portion 42*i* in the illustrated configuration. The light couplers 76*i* have the form of hinges that allow pivotal movement of the segments 78*i* and the light source 80*i*. While the illustrated configuration depicts the hinges providing rotational movement about one axis as adjacent segments 78*i* move in relation to one another, it will be understood that the light couplers 76*i* can provide, more generally, one or more of swivelling, rotating, turning, tilting, sliding, or otherwise positioning of adjacent segments 78*i* and the light source 80*i*.

In still another configuration, as illustrated in FIGS. 8K-8N, instead of mounting the lighting device 14*k* to the receiving port 36 (FIG. 5A), the lighting device 14*k* can selectively mount to the base 12*k* so that the functionality of the illumination can be added to the furniture console. As illustrated, the base 12*k* includes a mounting assembly 37*k* that is complementary to a light mounting assembly 88*k* of the lighting device 14*k*. The mounting assembly 37*k* and the light mount assembly 88*k* can be complementary mechanical mount, such threaded fasteners or non-threaded fasteners, such as pins, clips, snap fits and tabs, friction or interference fit structure, hook and loop, and combinations and modifications thereof. Alternatively, the mounting assembly 37*k* and the light mount assembly 88*k* can be complementary magnetic mounts, such as permanent magnets, temporary magnets, or electromagnets. In one configuration, one of the mounting assembly 37*k* and the light mount assembly 88*k* has a first polarity and the other of the mounting assembly 37*k* and the light mount assembly 88*k* has a second polarity opposite to the first polarity so that the attractive forces between the mounting assembly 37*k* and the light mount assembly 88*k* maintain the lighting device 14*k* in contact with the base 12*k*. In either mechanical mount or magnetic mount, the light mount assembly 88*k* includes a light mount 89*k* that is at least partially retained within cavities 91*k* of a lighting body 87*k*, while the base mounts 58*k* are at least partially retained within cavities 59*k* of the base 12*k*.

To create an electrical connection between the lighting device 14*k* and the base 12*k* electrical contacts 41*k* of the base 12*k* can cooperate with electrical contacts 93*k* of the lighting body 87*k*. The electrical connection allows charging of a battery 65*k* that can power the lighting device 14*k*, such as the light source 80*k*, when the lighting device 14*k* is separate from the base 12*k*. While the lighting device 14*k* is mounted to the base 12*k*, the electricity storage assembly 64 (FIG. 5A) and the other electrical connections can power the lighting device 14*k*.

As illustrated in FIGS. 8K-8N, the lighting devices can have various shafts that extend from the light body, such as lighting bodies 87*k*, 87*m* and 87*n*. For instance, the lighting device 14*k* of FIGS. 8K-8L includes a flexible shaft 70*k* that can be selectively deformed to a particular position and maintain the light source 80*k* in the selected position until subsequently moved. In another configuration, the lighting device 14*m* is similar to the lighting device 14 of FIG. 1, while the lighting device 14*n* is similar to the lighting device 14*d* of FIGS. 8A-8C.

Returning to FIGS. 1-5B, and more particularly FIG. 4, the control region 52 can include a heating/cooling control actuator or button 90 that allows a user to switch between heating mode or cooling mode of a thermal energy transfer assembly 16. The heating/cooling control actuator or button 90 can also be illuminated by a LED or other light source with a color indicating the operational mode of the thermal energy transfer assembly 16. For instance, a red LED can be illuminated when the heating mode is operational, while a blue LED can be illuminated when the cooling mode is operational. While reference is made to illumination of the heating/cooling control actuator or button 90, it will be understood that a heating/cooling operational mode indicator can be separate from the heating/cooling control actuator or button 90.

The control assembly 50 also can include an electricity storage assembly status indicator 92 that indicates a charged status of the electricity storage assembly 64. In one configuration, differently colored LEDs can be illuminated and represent different charge levels. For instance, illumination of a green LED can represent a full charge, illumination of a yellow LED can represent a half charge, and illumination of a red LED indicates to a user that the electricity storage assembly 64 needs to be charged. It will be understood that various numbers, colors and charging levels can be represented by the indicator(s) 92.

The control assembly 50 can also include an integrated assistant control 94 that provides an interface to a virtual assistant, such as Alexa/Google Assistant or the like, with such interface optionally allowing control of the furniture console 10 using voice commands or other inputs. The integrated assistant control 94 can include a microphone 96 to receive audio instructions, a speaker 98 to delivery information, one or more light indicators 100 used to indicate the operational status of the virtual assistant, an optional power button 102 to separately activate the virtual assistant, and volume control buttons; a volume up button 104, a volume down button 106, and a mute button 108, which prevents the control assembly 50 from capturing noise or sound through the microphone 96. It will be understood that the "buttons" or other controls described herein can be mechanical or electromechanical buttons, touch-sensitive buttons associated with one or more touch-sensitive screens, and combinations and modifications thereof. Additionally, functionality of one or more of the buttons, switches, actuators, controllers, etc. can be combined so as to reduce the number and complexity of the furniture console 10.

Figure 9:
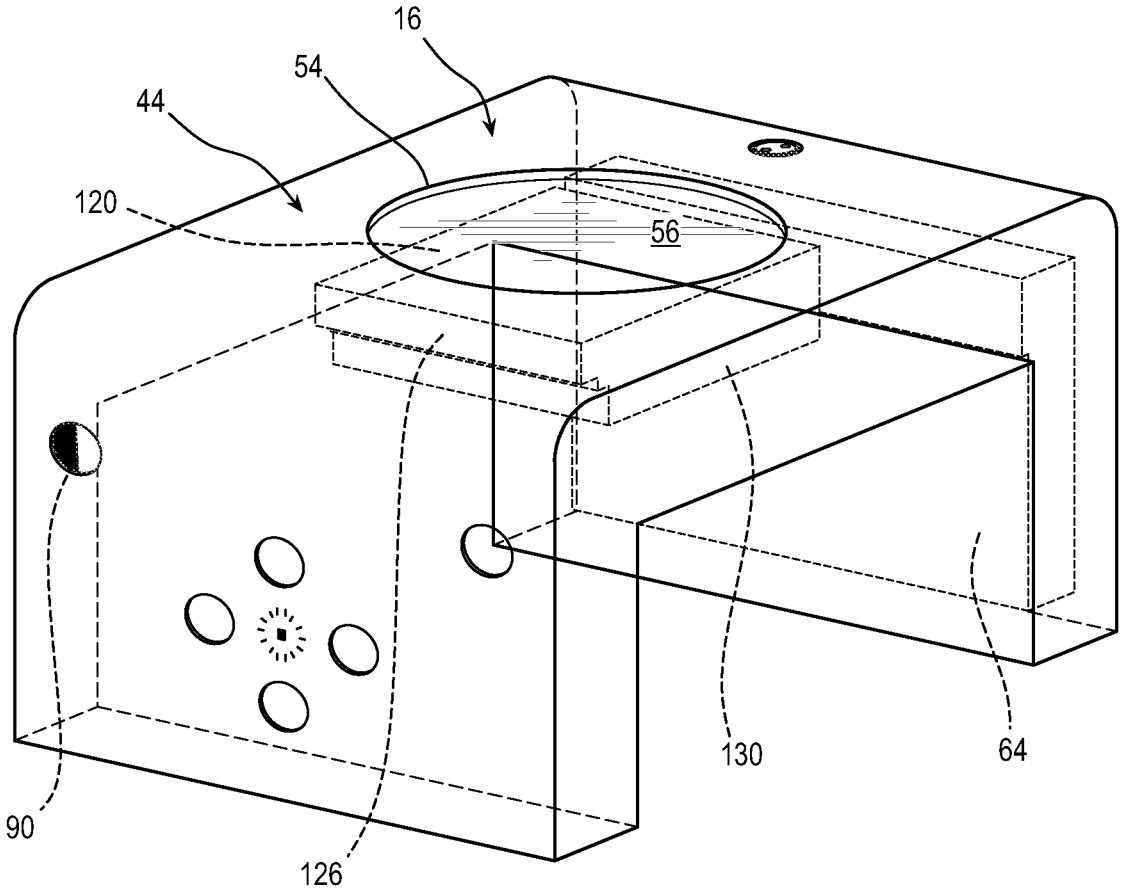
FIG. 9 is a partial perspective view illustrating a thermal energy transfer assembly of a furniture console.

As mentioned previously, and with reference to FIGS. 1, 9, and 10, the intermediate portion 44 includes the thermal energy transfer assembly 16 that allows for heating or cooling of the container 18 (FIG. 1) thermally communicating with the thermal energy transfer assembly 16. In this particular configuration, the thermal energy transfer assembly 16 can be switched between a heating mode to heat the container 18 or a cooling mode to cool the container 18, while in other configurations, the thermal energy transfer assembly 16 can either heat or cool the container 18. The thermal energy transfer assembly 16 uses a thermoelectric device to transfer heat from one side of a heat transfer structure or plate by creating a temperature differential between the two sides of the thermoelectric device based upon the applied voltage and current. For instance, the thermal energy transfer assembly 16 has a heat transfer structure 120. By changing the polarity of the heat transfer structure 120, such as by actuating the heating/cooling control button 90, the heat transfer structure 120, operates in either the heating mode or the cooling mode by changing a direction of current flow to the heat transfer structure 120. Changing the current flow changes which side of the heat transfer structure 120 is the "hot" side, thereby changing between cooling mode and heating mode. In one configuration, the heat transfer structure 120 is a Peltier plate.

The intermediate portion 44 includes an upper recess 54 the receives the container 18. A recess lower surface 56 of the upper recess 54 is thermally coupled with or is a portion of the thermal energy transfer assembly 16. For instance, in the illustrated configuration the recess lower surface 56 is formed by an upper plate surface 122 of the heat transfer structure 120, with a lower plate surface 124 cooperating with a heat sink 126. A fan 130 is disposed below the heat sink 126, and optionally mounted to the heat sink 126, to aid with moving air past the heat sink 126. When the thermal energy transfer assembly 16 is operating in a cooling mode, the fan 130 draws air past the heat sink 126 to transfer heat from a "hot" side of the heat transfer structure 120 and the heat sink 126 to the moving air. When the thermal energy transfer assembly 16 is operating in cooling mode, the fan 130 also draws air past the heat sink 126.

Figure 10:
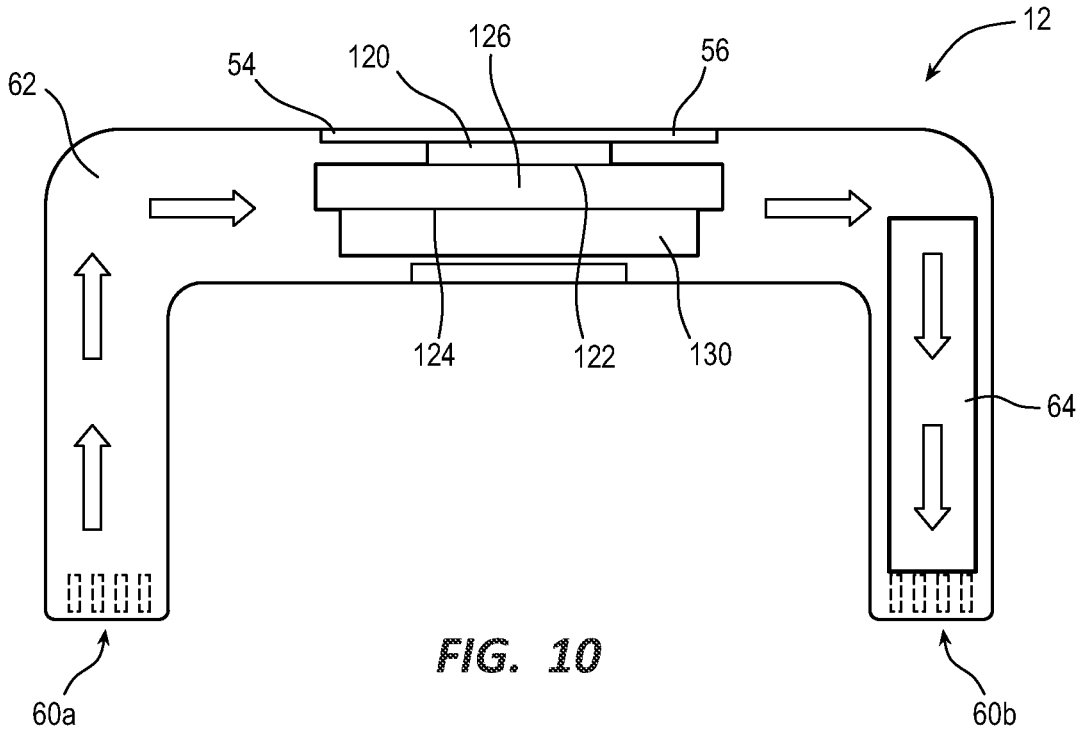
FIG. 10 is a cross-sectional view illustrating an air flow path incident upon and away from the thermal energy transfer assembly of a furniture console.

To aid with the air flow, the first leg portion 40 and the second leg portion 42 include vent ports 60*a*, 60*b* respectively. As illustrated in FIG. 10, air flows within and through an interior space 62 of the base 12 from the first vent ports 60*a* in the first leg portion 40 to the second vent ports 60*b* in the second leg portion past the heat sink 126. With the illustrated configuration of FIG. 10, except for the outer periphery formed by the body of the base 12, the interior space 62 is generally devoid of structures that would direct or guide air flow from the first vent ports 60*a* to the second vent ports 60*b*, with the air being used to cool the heat sink 126 and the electricity storage assembly 64. In other configurations, the interior space 62 can include divertors, deflectors, baffles, guides, or other structures to create a plurality of air flow paths to provide directed air flow to the heat sink 126 and the electricity storage assembly 64. For instance, when the furniture console 10 is operating in the cooling mode, the side of the heat transfer structure 120 towards the heat sink 126 will increase in temperature. Increasing air flow past the heat sink 126 allows for increased heat dissipation. Similarly, when the electricity storage assembly 64 is being charged, as will be described in more detail later, increasing air flow to the electricity storage assembly 64 will increase heat dissipation and cool the electricity storage assembly 64.

Figure 11A:
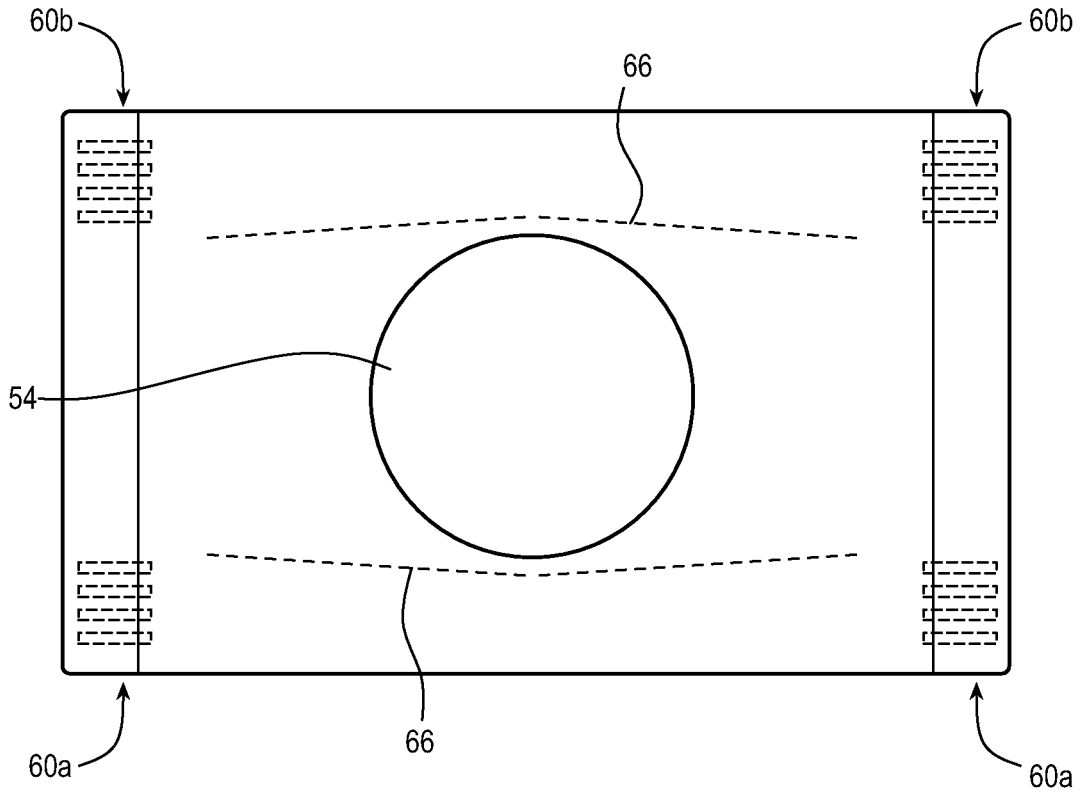
FIG. 11A is a top view illustrating baffles to create an air flow path incident upon and away from the thermal energy transfer assembly of a furniture console.
Figure 11B:
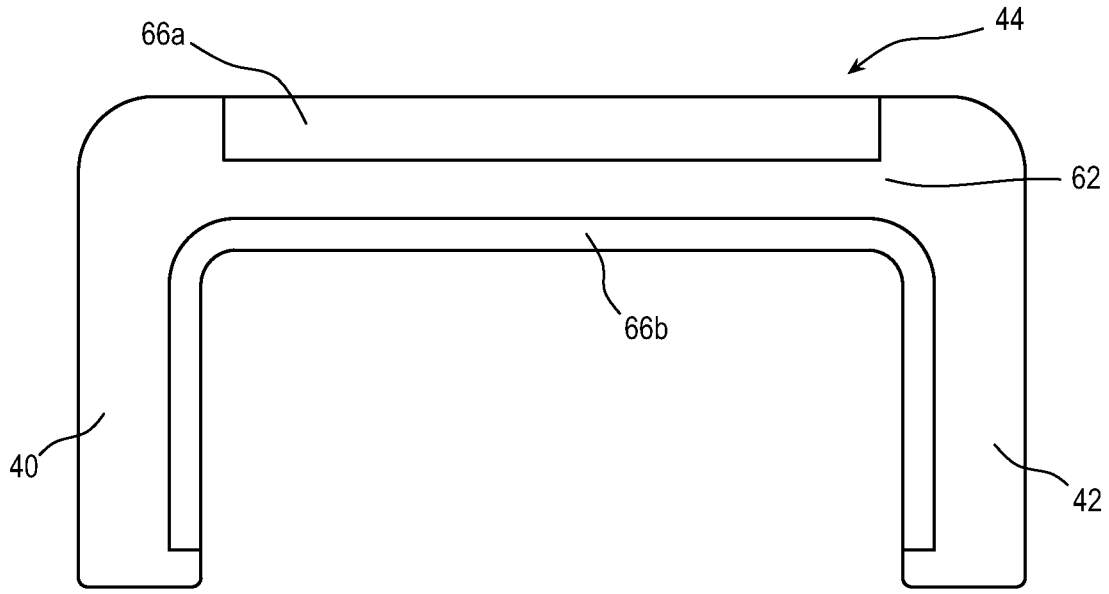
FIG. 11B is a cross-sectional view illustrating baffles to create an air flow path incident upon and away from the thermal energy transfer assembly of a furniture console.

Turning to FIG. 11A, guides or baffles 66 are formed within the interior space 62. The baffles 66 guide the air flow around or past the thermal energy transfer assembly 16 to provide different flow channels to direct the air. The baffles 66 guide the air towards the vent ports 60*a*, 60*b*. In FIG. 11*b*, a first baffle 66*a* extends from a top portion of the base 12, while a second baffle 66*b* extends from a bottom portion of the base 12, and optionally along one or both of the first leg portion 40 and the second leg portion 42. The location of the first baffle 66*a* and the second baffle 66*b* aid to direct the air flow to specific components or locations within the interior space 62. For instance, the portions of the second baffle 66*b* formed or otherwise associated with one or both of the first leg portion 40 and the second leg portion 42 guide the air flow to the vent ports 60*a*, 60*b*. The first baffle 66*a* and the second baffle 66*b* towards the intermediate portion 44 of the base 12 can direct the air flow towards and away from thermal energy transfer assembly 16, such as the heat sink 126 and the fan 130.

Figure 11C:
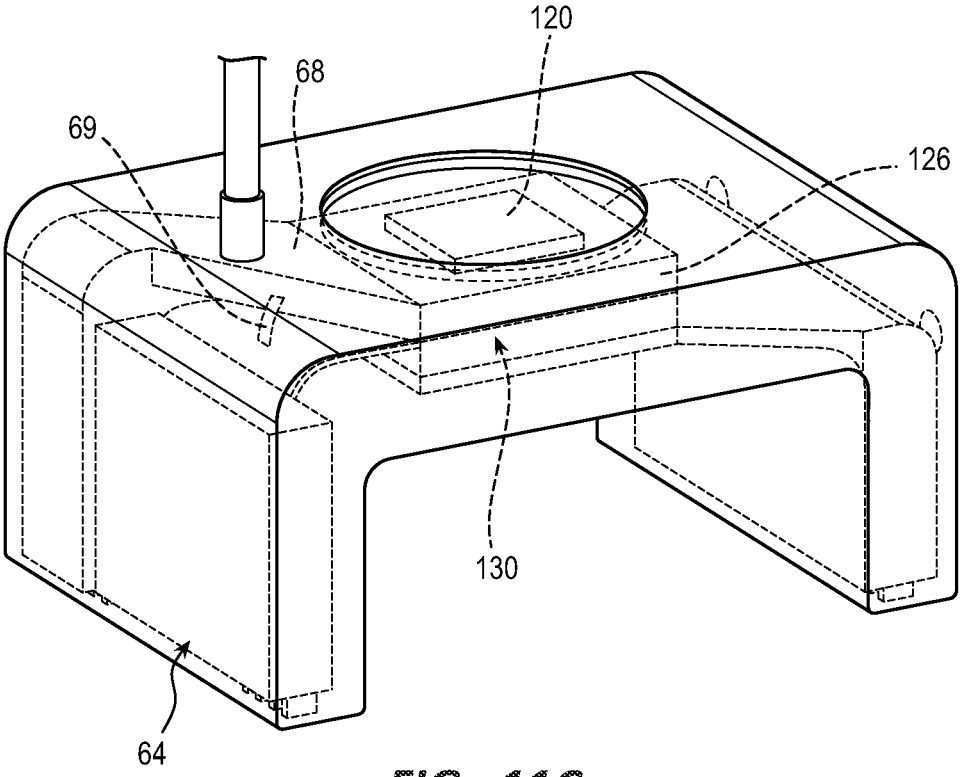
FIG. 11C-11D is a partial perspective view illustrating baffles to create an air flow path incident upon and away from the thermal energy transfer assembly of a furniture console.
Figure 11D:
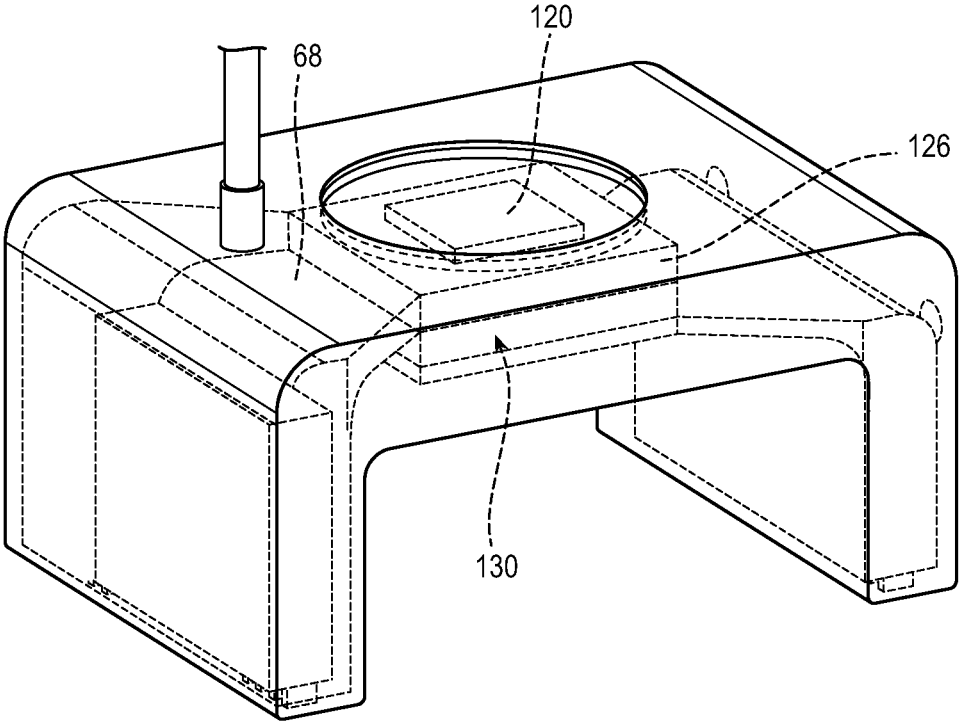

Turning to FIGS. 11C and 11D, the interior space 62 can include a diverter 68 that can be selectively adjusted to direct the flow of air. As illustrated in FIG. 11C, with the diverter 68 raised, such as when the thermal energy transfer assembly 16 is operating in cooling mode, the diverter 68 directs warm exhaust air away from the electricity storage assembly 64 to prevent overheating of the electricity storage assembly 64. For instance, an actuator 69 maintains the diverter 68 in a raised position and, being partially inclined in relation to a direction of flow of air moving from the first leg portion 40 towards the second leg portion 42, directs the air flow past the electricity storage assembly 64. In FIG. 11D, with the electricity storage assembly 64 in the heating mode, the diverter 68 is moved by the actuator 69 from a raised, upright position to a generally planar, flat orientation to direct cold or cool exhaust air towards the electricity storage assembly 64. The actuator 69 can be a mechanical, electromechanical, hydraulic, pneumatic, combinations and modifications thereof or other type of actuator that moves the diverter 68 between the raised and lowered positions.

Figure 12:
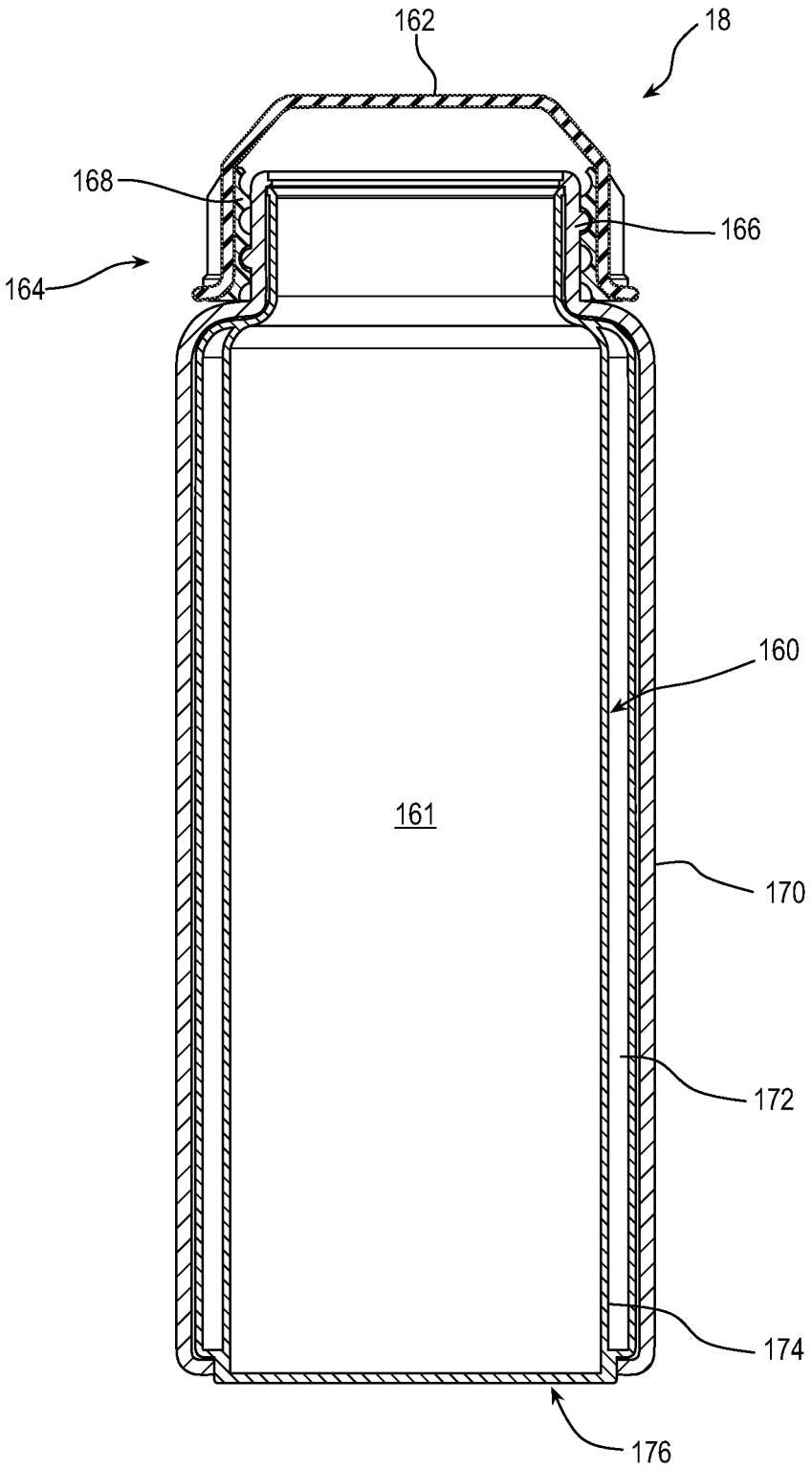
FIG. 12 is a cross-sectional view of a container useable with a furniture console.

As mentioned above, the furniture console 10 can be used to heat or cool the container 18, such as the container 18 of FIG. 12. The container 18 includes a body 160 having a liquid receiving chamber 161, a lid 162 that mounts to a first end 164 of the body 160, such as via complementary threads 166 and 168 formed, respectively, on the first end 164 of the body 160 and the lid 162. Alternative, the lid 162 can frictionally or by interference engage with the first end 164 to retain the lid 162 to the body 160. More generally, the lid 162 and the first end 164 have complementary structures to allow the lid 162 and the body 160 to releasably couple together.

To aid with heating and cooling, the container 18 can include an inner wall 170, an outer wall 174, and an insulative layer 172 at least partially disposed between the inner wall 170 and the outer wall 172. The insulative layer 172 extends from the first end 164 of the container 18 towards a bottom end 176, and stops before the bottom end 176 so that the inner wall 174 at the bottom end 176 is uninsulated. Stated another way, the bottom end 176 of the container 18 includes the inner wall 174 and no insulative layer 172 and outer wall 170. This allows for energy transfer to container 18 from the thermal energy transfer assembly 16 through the bottom end 176, and so the contents of the container 18.

Figure 13:
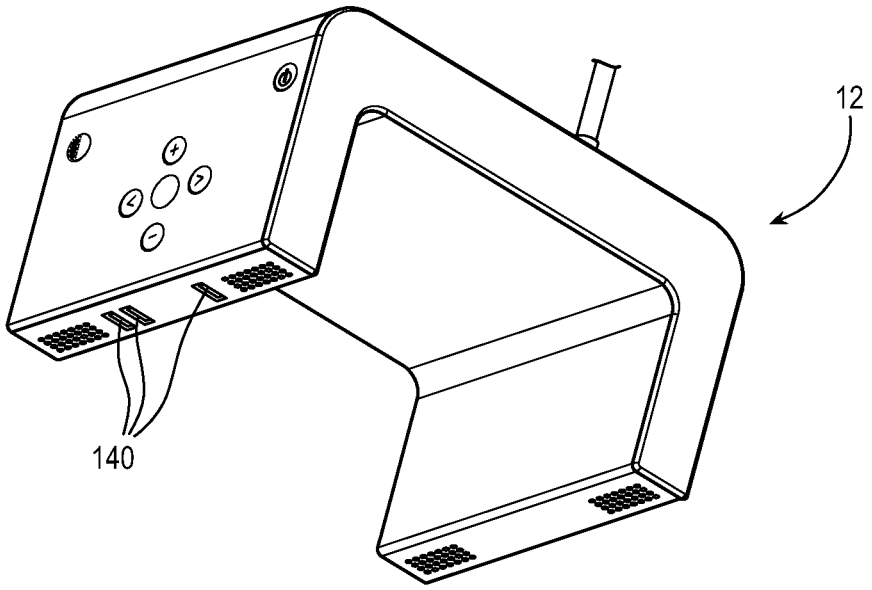
FIG. 13 is a perspective view illustrating USB ports of a furniture console.
Figure 14:
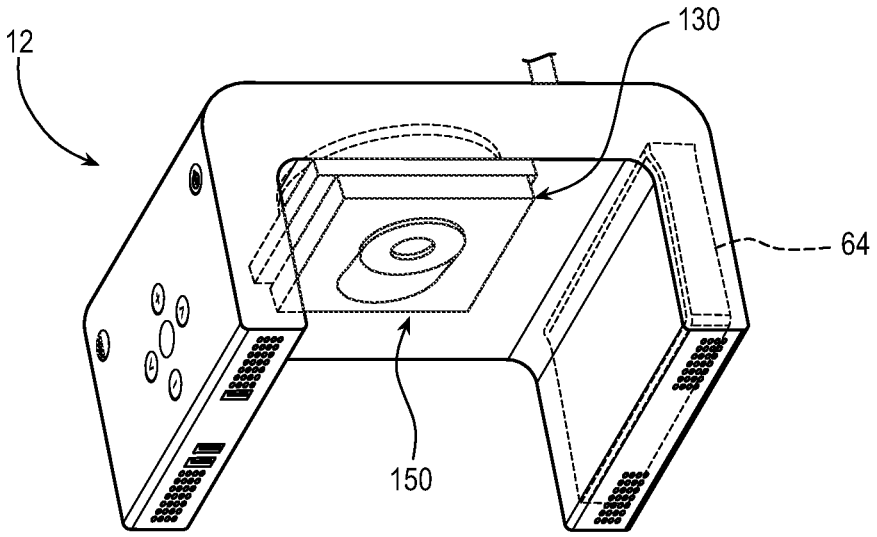
FIG. 14 is a partial perspective view illustrating an electricity storage assembly and a wireless charging assembly of a furniture console.
Figure 15:
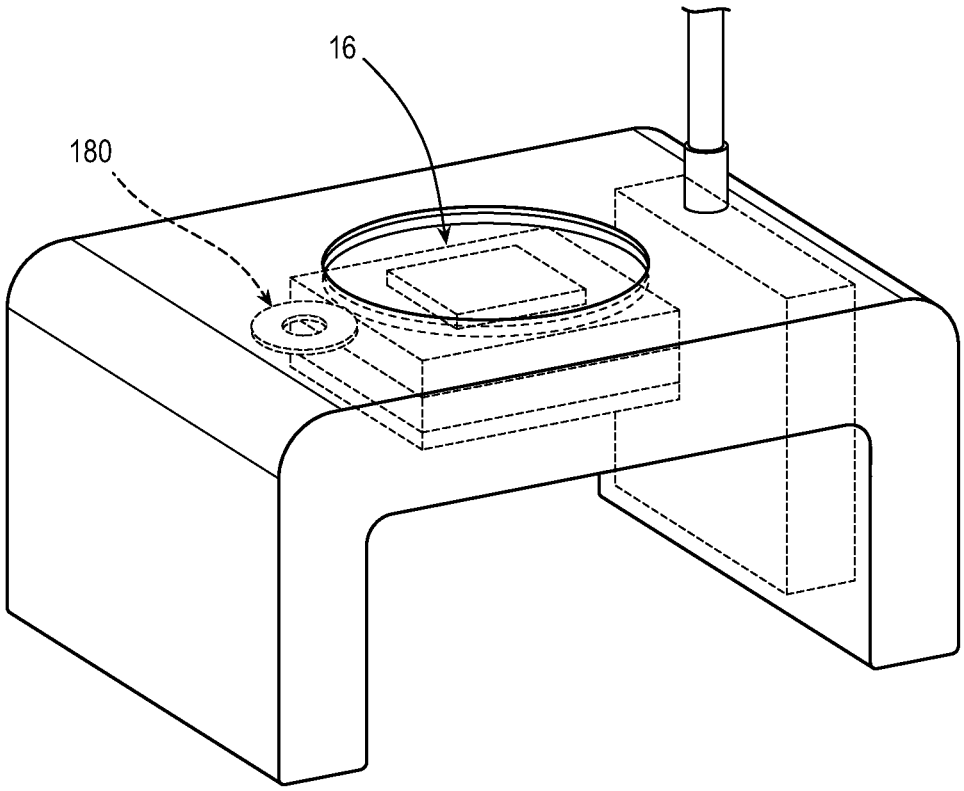
FIG. 15 is a partial perspective view illustrating an induction charger of a furniture console.

As mentioned above, the second leg portion 42 includes the electricity storage assembly 64, such as a battery pack. The electricity storage assembly 64 can be charged through direct electrical connection to mains power, such as via a Universal Serial Bus (USB) port 140 illustrated in FIGS. 13-15, connecting to a separate electricity storage assembly, or via a wireless charging receiver array 150. In the illustrated configuration, the wireless charging receiving array 150 is positioned below the fan 130 in the intermediate portion 44, although it can be positioned at various other locations of base 12. The wireless charging receiving array 150 includes 3 or more receivers to allow for easier positioning over a complementary wireless transmitter, such as the wireless transmitting array or inductive charger 152 illustrated in FIG. 1. Although 3 or more receivers can be included in the wireless charging receiving array 150, it will be understood that 1, 2, 3, or more receivers can be used. Additionally, as illustrated in FIG. 15, a wireless charging transmitting array or inductive charger 180 can be disposed towards an upper surface 24 of the intermediate portion 44 to charge a device place thereupon, such as a cellphone or other device that can be charged through induction charging or similar approach. While the wireless charging receiving array 150 is used to charge the base 12, the wireless charging transmitting array 180 can be used to charge other devices. Placing the wireless charging transmitting array 180 near or within the flow of air being directed towards the thermal energy transfer assembly 16 allow the cooling air to cool the wireless charging transmitting array 180, thereby allowing for longer periods of fast charging.

With the wireless charging receiving array 150 positioned on a lower surface of the intermediate portion 44, it can cooperate with the wireless charging transmitter array or inductive charger 152 mounted in the furniture assembly 20 (FIG. 1). Additional details of the complementary wireless charger, and details of an example of the wireless charging array or inductive charger 180 can be found in U.S. patent application Ser. No. 16/738,916, filed Jan. 9, 202, and entitled "Electronic Furniture Systems with Integrated Induction Charger" and U.S. patent application Ser. No. 17/128,575, filed Dec. 21, 1920 and entitled "Electronic Furniture Systems with Integrated Induction Charger," the disclosures of which are incorporated herein in their entireties by this reference.

The furniture console 10 can be used with various furniture assemblies, such as furniture assembly 20 (FIG. 1). FIGS. 16-20 illustrate a modular furniture assembly 200, which is a configuration of one of the furniture assemblies schematically illustrated in FIG. 1. While reference is made to use or interaction of the furniture console 10 with a modular furniture assembly as described herein, it will be understood by those in the art that the furniture console 10 can be used with other non-modular furniture products, other non-furniture products, and other structures that can accommodate and/or receive the furniture console 10 as will be understood or contemplated by the present disclosure.

Figure 16:
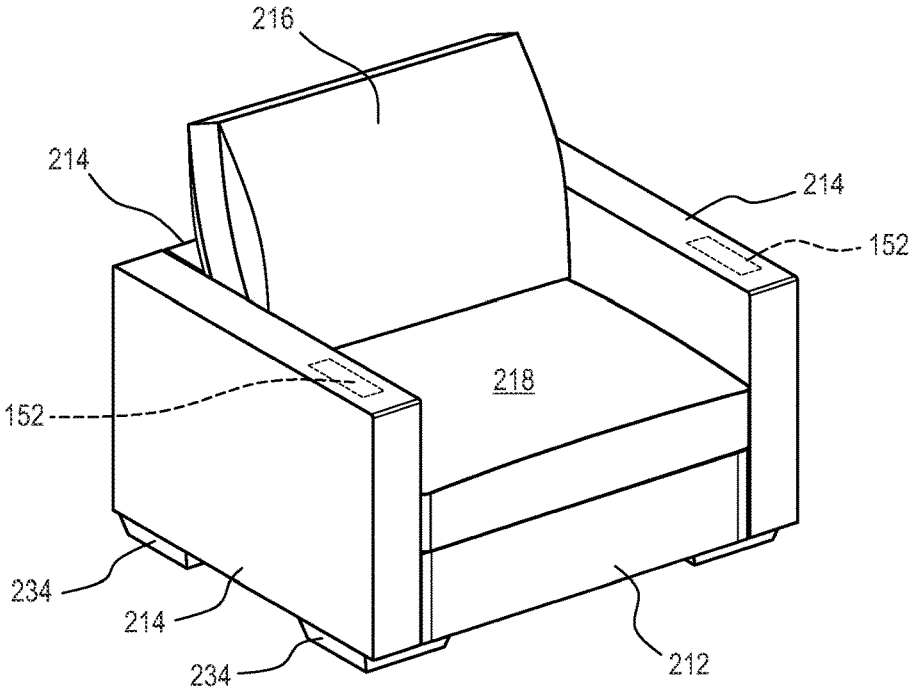
FIG. 16 is perspective views illustrating a modular furniture assembly having a base coupled to a transverse/upright member to form a chair that can be used with a furniture console, the modular furniture assembly being electrical coupled to an external electricity source.

FIG. 16 is a perspective view of a modular furniture assembly in the form of a chair of the present invention having an induction charger or wireless transmitter 152 that can be used to wirelessly charge electrical devices, e.g., phones, etc., embedded in the transverse members thereof. As shown in FIG. 16, the modular furniture system 200 includes a base 212 selectively coupled to a transverse member 214. The base 212 and transverse members 214 can be connected as illustrated in FIG. 16, with cushions 216 and 218 and foot couplers 234 that can couple bottom portions of transverse members 214 and bases 212 to each other.

Further discussion and disclosure relating to the modular furniture assemblies 10 and their connection to each other and to the transverse members 14 are shown and discussed in the following patents and patent applications, each of which are incorporated herein in their entireties by this reference: (i) U.S. patent application Ser. No. 14/332,705, filed Jul. 16, 2014, entitled MOUNTING PLATFORM FOR MODULAR FURNITURE ASSEMBLY, (ii) U.S. Pat. No. 8,783,778, entitled MOUNTING PLATFORM FOR MODULAR FURNITURE ASSEMBLY, (iii) U.S. Pat. No. 7,963,612 entitled MODULAR FURNITURE ASSEMBLY, (iv) U.S. patent application Ser. No. 11/449,074, filed Jun. 8, 2006, entitled MODULAR FURNITURE ASSEMBLY, now U.S. Pat. No. 7,547,073, (v) U.S. Pat. No. 7,213,885 entitled MODULAR FURNITURE ASSEMBLY, (vi) U.S. Provisional Application No. 62/354,426 filed Jun. 24, 2016 entitled MODULAR FURNITURE ASSEMBLY CORNER SEATING SYSTEM; (vii) U.S. Provisional Patent Application Ser. No. 62/257,623, filed on Nov. 19, 2015, entitled FURNITURE WITH ELECTRONIC ASSEMBLIES; (viii) U.S. patent application Ser. No. 15/270,339, filed on Sep. 20, 2016, entitled ELECTRICAL HUB FOR FURNITURE ASSEMBLIES; (ix) U.S. patent application Ser. No. 15/276,524, filed Sep. 26, 2016, entitled Modular Furniture Assembly Corner Seating System; and (x) U.S. patent application Ser. No. 15/342,800, filed Nov. 3, 2016, entitled Furniture System with Recliner Assembly, each of which are incorporated in their entireties herein by this reference.

The bases and transverse members of the present invention can include one or more covers (e.g., an inner cover and an outer cover). Such covers have various advantageous, such as that the outer covers are conveniently removable so that the user can remove the covers, wash them, and swap them with other covers as desired.

Figure 17:
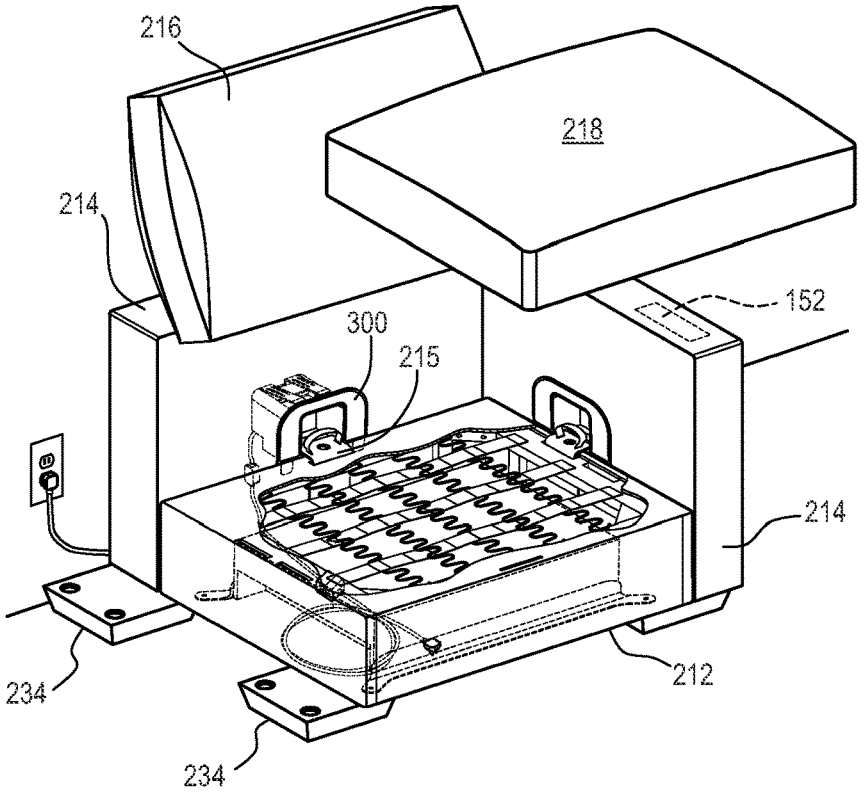
FIG. 17 is a chair as in FIG. 16, with the cushions exploded therefrom and a cutaway view of the base shown.

FIG. 17 shows an exploded view of the furniture system 200 of FIG. 16 showing use of: (1) selectively mounting couplers 215 which couple transverse members 214 o base 12; (2) integral electrical hubs 300 mounted internally within the furniture system 200 to provide a source of electrical power; as well as (3) details of base 212, including cushioning assemblies and integral, inductor charger 152.

Figure 18:
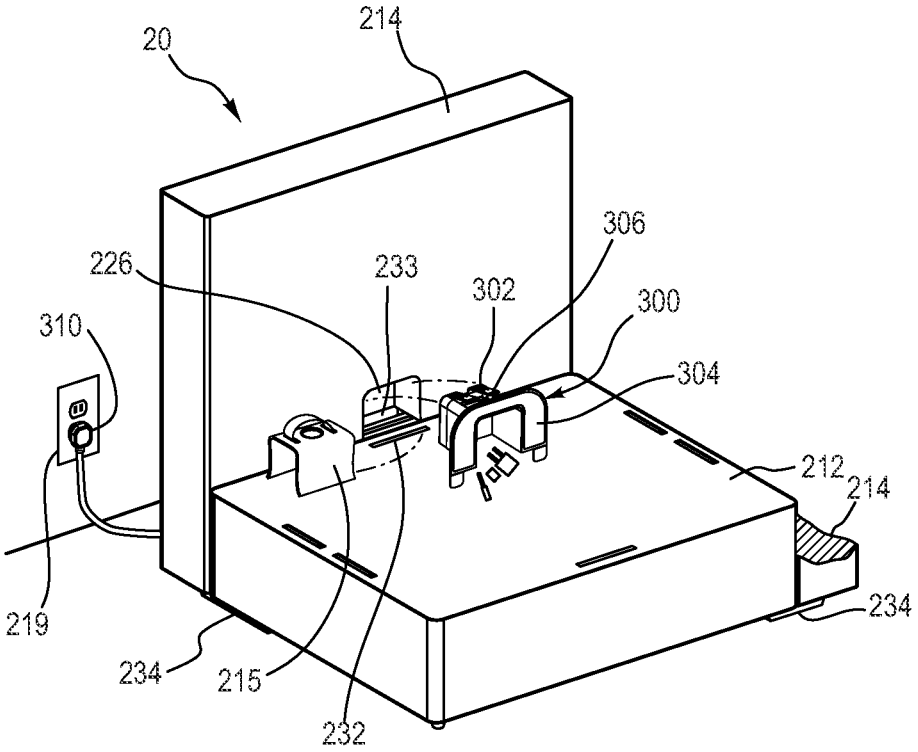
FIG. 18 illustrates the modular furniture assembly of FIGS. 16 and 17 in an exploded view with an electrical hub configured to be mounted within the modular furniture assembly.

FIG. 18 illustrates the modular furniture assembly 200 in an exploded view with the addition of certain electronic assemblies which connect to an electrical hub 300 configured to be mounted within the modular furniture assembly. The hub 300 is used to provide electrical power to the induction charger 152, and optionally other electrical components. Base 212 of furniture assembly 200 is selectively coupled to first and second transverse members 214 of furniture assembly 200, a second transverse member being shown in a partial view in FIG. 18.

Each transverse member 214 has a cavity 226 in a middle, lower portion thereof. A U-shaped coupler 215, selectively couples an upper portion of a base 212 to a middle, lower portion of a transverse member 214. Foot couplers 234 selectively couple respective feet of base 212 to respective feet of the transverse members 214. Foot couplers 234 have apertures therein that receive the feet of respective adjacent bases and transverse members, coupling them to each other.

In one embodiment, a foot coupler such as coupler 234 can be placed under a foot of a base that is not adjacent a transverse member or other base, for aesthetic continuity and/or to provide a level surface of all four corners of the base. Furniture assembly 200 is a modular furniture assembly that can be assembled as illustrated in FIG. 5, for example.

As illustrated in FIG. 18, a U-shaped coupler 215 selectively connects a portion of base 212 to a portion of a transverse member 214 by placing one plate of the U-shaped coupler 215 within an aperture 232 in the frame of base 212 and another plate of the U-shaped coupler 215 within an aperture 233 in the frame of transverse member 214 that is in the cavity 226 of transverse member 214, thereby selectively coupling base 212 to transverse member 214. The second transverse member 214, shown in partial view in FIG. 18, and/or additional transverse members 214, can be selectively coupled similarly or in exactly the same manner to base 212.

Base 212 is used as a seat member and/or for receiving a cushion 218 to be used as a seat member while transverse member 214 can be used as a backrest and/or arm rest. Various combinations of bases, transverse members, and U-shaped couplers and foot couplers can be used in varying numbers to create a variety of different furniture assemblies of the present invention, as discussed and illustrated in the patents and patent applications that are incorporated in their entireties herein by this reference.

Electrical hub 300 is also shown in an exploded view in FIG. 18, electrical hub 300 is selectively mounted within the cavity 226 of transverse member 214 and a portion of an electrical hub 300 being selectively sandwiched between a portion of base 212 and a portion of transverse member 214, thereby maintaining hub 300 in a convenient, stable position within furniture assembly 20. Hub 300 acts as a convenient power source for the inductive charger 152 (FIG. 19) and optionally other devices needing power. It will be understood that while reference is made to inclusion of an "electrical hub" which can be an electrical power source for devices plugged or otherwise connected to receptacles associated with the "electrical hub" and also power to the inductive charger 152 (FIG. 19), it is understood that power can provided directly to the inductive charger 152 (FIG. 19) from the electrical wall outlet 219 via the electrical cord 310 without the electrical hub 300. Further, the electrical hub 300 can be used with various bases and transverse members, and not limited to those illustrated herein.

The drawings provided herein show hub 300 in use in connection with modular furniture. However, hub 300 is conveniently used in connection with various types of furniture, including: (i) fixed, non-configurable furniture; (ii) furniture that is assembled by a consumer (known as "assemble-able furniture"); and furniture that can be configured into a variety of different configurations (known as "modular furniture"). Assemble-able furniture includes (i) modular furniture that can be configured into a variety of different configurations and (ii) furniture that can only be assembled into a single configuration. Hub 300 is conveniently used in connection with various types of furniture, including (i) fixed-nonconfigurable, (ii) assemblable-modular and (iii) assemblable-non-modular furniture.

When cushion 218 (FIG. 17) is placed onto base 212 and adjacent transverse member 214 of FIG. 18, hub 300 is not visible to the user, with the exception of the portion of the electrical cord 310 that extends from behind furniture assembly 20 and into the electrical wall outlet 219. For example, when cushion 218 of FIG. 17 is placed on the base 212 and adjacent transverse member 214, hub 300 is not visible to the user, as shown in FIG. 16.

The furniture assembly of FIG. 18 thus includes: (i) a furniture assembly 20 including (A) a base 212, (B) a transverse member 214, and (C) a coupler 215 for coupling the base 212 to the transverse member 214; and (ii) an electrical hub 300 as shown in FIG. 18 configured to selectively reside within the furniture assembly 20.

Although FIG. 18 illustrates a furniture assembly 10 that includes two transverse members 214, and a base member 212, in other embodiments, the hub 300 or hubs 300 may be used in other combinations of transverse members 214 and base members 212, such as those disclosed in the aforementioned patents and applications, hub 300 being configured to be disposed partially within at least one of the transverse members 214 of such assemblies. When positioned thereon, cushion 218 hides the hub 300 from view.

As shown in FIG. 18, in one embodiment, the electrical hub 300 includes: (a) an electrical outlet assembly 102; (b) a securement panel 304 wherein a rear face of the securement panel 304 is linked to the electrical outlet assembly 302, such that at least one outlet of the electrical outlet assembly 302 is spaced away and offset from the securement panel 304; and (c) an installation clip 306 mounted to the electrical outlet assembly 302, the installation clip 306 being moveable with respect to the electrical outlet assembly 302, the installation clip 306 having an extended position and being capable of being moved to a compressed position when it is desired to move the hub into cavity 226. Electrical outlet assembly 302 includes electrical cord 310 and at least one electrical outlet in electrical communication with cord 310.

The free end of the installation clip 306 is movable with respect to the assembly and is configured to be normally in the extended position absent any other force, and is selectively moved by a user from the extended position to the compressed position in order to mount the electrical hub 300 within the furniture assembly 200. Clip 306 is further configured to be selectively moved by a user from the extended position to the compressed position in order to remove the electrical hub 300 from the furniture assembly.

Additional information regarding hub 300 is disclosed in U.S. patent application Ser. No. 15/270,339, filed on Sep. 20, 2016, entitled "Electrical Hub for Furniture Assemblies," which is incorporated herein by this reference.

Figure 19:
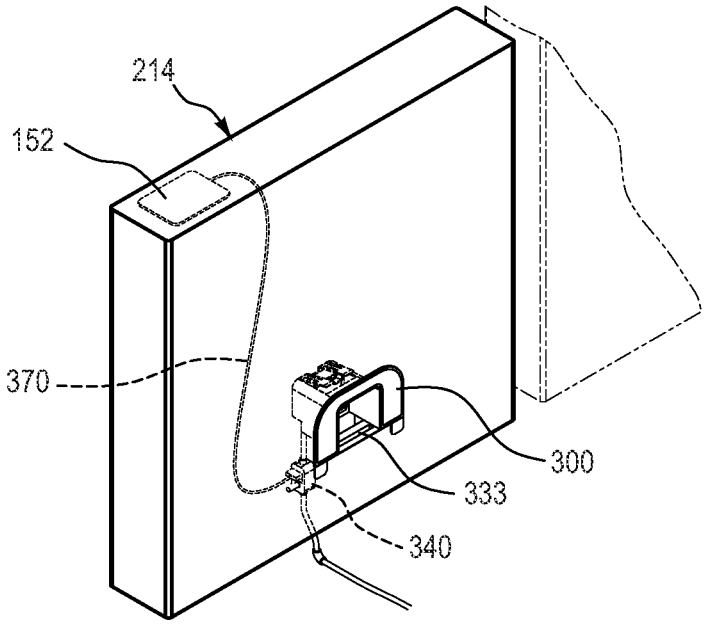
FIG. 19 is a perspective view of a transverse member of the present invention, including phantom views of certain electronic components internally mounted and connected to a hub of the present invention. An adjacent transverse member is also depicted.

FIG. 19 is a perspective view of a transverse member of the present invention, including phantom views of the induction charger 152 connected to the hub 300 via the cord 370 and the interior outlet or electrical junction 340. An optional adjacent transverse member is also depicted. FIG. 19 illustrates a transverse member 214 of the present invention having an electrical hub 300 mounted therein, wherein the induction charger 152 is fed electrical power through the electrical hub, the induction charger being mounted within the transverse member. Using induction charger 152 mounted within a transverse member 14, a user seated on a furniture assembly 20 can conveniently recharge an electrical device, such as a cellular phone, while seated on the modular furniture assembly. Additionally, the induction charger 152 can be used to charge the furniture console 10 (FIG. 1)

Wireless qi charging, e.g., via induction charger 152 embedded within the transverse member or other devices is used to charge mobile devices, such as cellular phones, computers, lighting systems, lamps, or other electronic devices, including the furniture console 10 (FIG. 1). As shown in FIG. 19, the qi charger, also known as an induction charger, may be hidden under furniture covers and/or embedded within the wooden frame of an embodiment of transverse member 214. In one embodiment, the induction charger is mounted on an upper surface of one or more transverse members under a thin cover in order to provide easy access for the furniture console 10. The induction charger charges though layers of fabric when desired. The induction charger may be placed in a variety of locations such as within the transverse member or the base.

Figure 20:
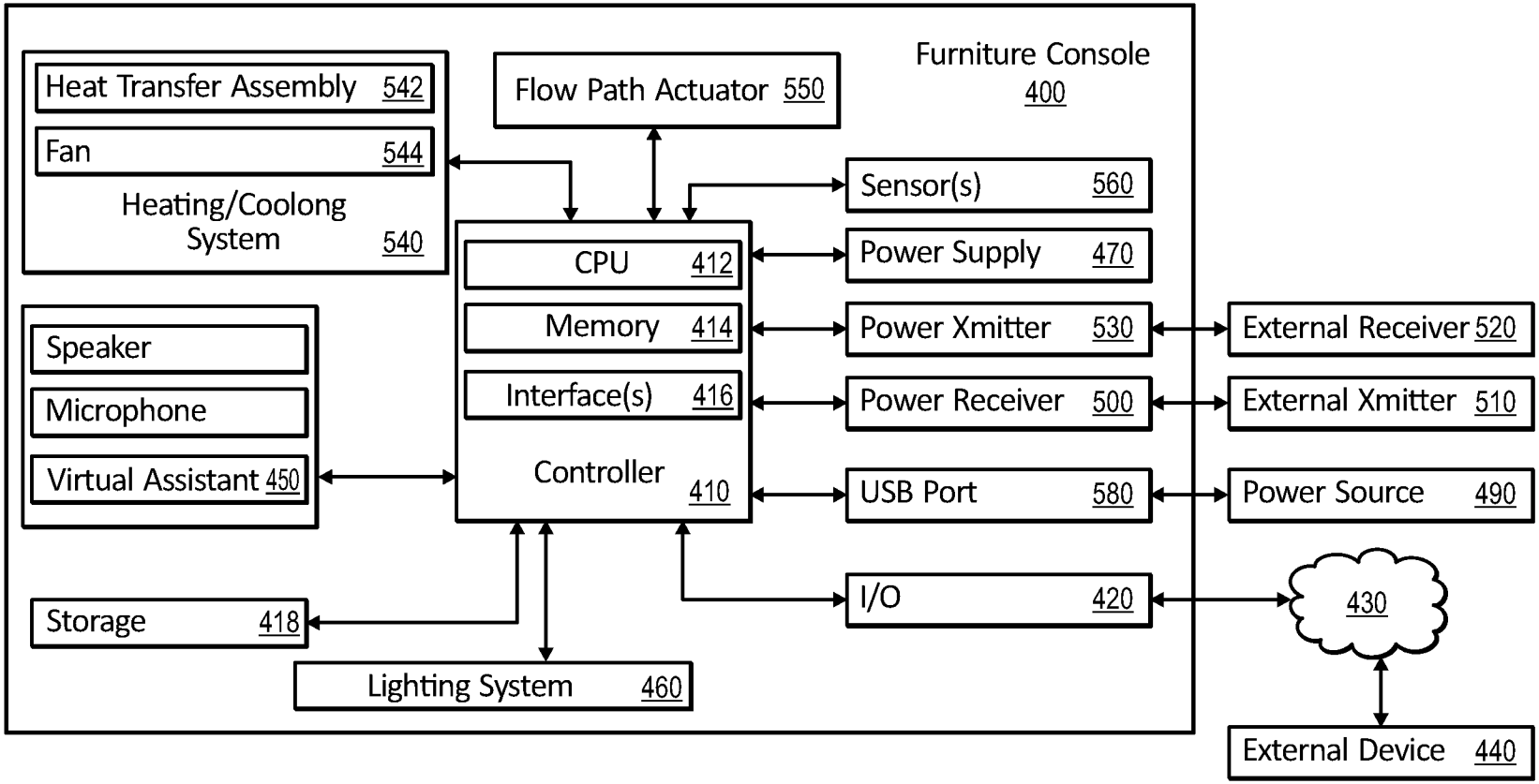
FIG. 20 is a schematic representation of a furniture console.

Turning to FIG. 20, illustrated is a schematic representation of the furniture console, which was previously described the context of FIGS. 1-19. The disclosure related to the configurations of FIGS. 1-19 is also applicable to the furniture console 400 illustrated in FIG. 20.

The schematic illustration of portions of the furniture console described here can be considered as representations of functional modules or components to perform particular operations. Generally, the operation modules described herein may refer to software objects or routines that execute on a special purpose processing device to perform a certain function or group of functions. In at least some instances, a hardware processor is provided that is operable to carry out executable instructions for performing a method or process, such as the methods and processes disclosed herein. It is contemplated that implementations in hardware or a combination of software and hardware are possible. For instance, the controllers, modules, actuators, etc. described herein may include the use of computer hardware or software modules. Such hardware and software modules or structures may include a processor and computer storage media carrying instructions that, when executed by the processor and/or caused to be executed by the processor, perform any one or more of the methods disclosed herein, or any part(s) of any method disclosed. By way of example, and not limitation, such computer storage media may comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which may be used to store program code in the form of computer-executable instructions or data structures, which may be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

With reference to FIG. 20, furniture console 400 can be used to perform any of the operations described herein. Furniture console 400 may take various different forms and can be embodied with or in various hardware and/or software modules and components that communicate to achieve the functions described herein. In some circumstances, the furniture console may form part of a distributed system that includes one or more connected computing components/devices that are in communication with furniture console and/or perform the functions of the furniture console. As described herein, the furniture console 400 provides a user with various capabilities, such as one or more of charging electronic devices, heating/cooling containers, improving lighting conditions, accessing knowledge bases via internet connections, providing control of connected devices, interfacing with a virtual assistant, and providing other capabilities.

In its most basic configuration, the furniture console 400 includes various different components. FIG. 20 shows that the furniture console 400 includes a controller 410 in communication with a storage 418. The controller 410 has one or more processor(s) 412 (or a "hardware processing unit"), memory 414, and interfaces 416. The controller 410 can function as the control assembly 52 (FIG. 4) and aid with communication (via a wired or wireless connection), such as through the input/output interface 420, to a network 430 and external devices 440 connectable to the network 430. For example, the furniture console 400 can communicate with any number devices (e.g., external devices 440) or cloud services to obtain or process data. In some cases, network 430 may itself be a cloud network. Furthermore, the furniture console 400 may also be connected through one or more wired or wireless networks 430 to remote/separate computer systems(s) that are configured to perform any of the processing described with regard to the furniture console 400, those remote/separate computer systems can be considered as the external device 440. Additionally, the external device 440 can be computer system(s) to which the virtual assistant 450, such as the integrated assistant control 94 (FIG. 4), can communicate with to gather requested information. Additionally, the external device 440 can be mechanical, electromechanical, electrical, hardware and/or software components, systems, and modules, including but not limited to remote audio and/or video components or structures, computers, or other devices that a user could use to improve an individual's experience with or without a furniture system or assembly. For instance, and not by way of limitation, the external device 440 can include speaker controllers, amplifiers, audio equalizers, receivers, set top boxes, satellite receivers, projectors, televisions, compact disc players, digital video disc players, Blu-Ray players, other display devices, control panels, and combinations and modifications thereof. The furniture console 400, and other furniture consoles described or otherwise contemplated by this disclosure, can also perform the operations and methods described in U.S. patent application Ser. No. 16/696,696 filed Nov. 26, 2019, entitled MODULAR FURNITURE SPEAKER ASSEMBLY WITH RECONFIGURABLE TRANSVERSE MEMBERS; U.S. patent application Ser. No. 16/273,773 filed Feb. 12, 2019, entitled ELECTRONIC FURNITURE SYSTEMS WITH INTEGRATED INTERNAL SPEAKERS; U.S. patent application Ser. No. 15/348,068 (now U.S. Pat. No. 10,212,519), filed on Nov. 10, 2016, entitled ELECTRONIC FURNITURE SYSTEMS WITH INTEGRATED INTERNAL SPEAKERS; U.S. patent application Ser. No. 15/270,339 (now U.S. Pat. No. 10,236,643), filed on Sep. 20, 2016, entitled ELECTRICAL HUB FOR FURNITURE ASSEMBLIES; U.S. Provisional Patent Application Ser. No. 62/257,623, filed on Nov. 19, 2015, entitled FURNITURE WITH ELECTRONIC ASSEMBLIES; U.S. Provisional Patent Application Ser. No. 62/417,091, filed on Nov. 3, 2016, entitled ELECTRONIC FURNITURE SYSTEMS WITH INTEGRATED INTERNAL SPEAKERS; and U.S. Patent Application Ser. No. 63/173,899 filed Apr. 12, 2021, entitled TUNING CALIBRATION TECHNOLOGY FOR SYSTEMS AND METHODS FOR ACOUSTICALLY CORRECTING SOUND LOSS THROUGH FABRIC, the disclosures of which are incorporated herein in their entireties by this reference.

A "network," like network 430, is defined as one or more data links and/or data switches that enable the transport of electronic data between computer systems, modules, and/or other electronic devices. When information is transferred, or provided, over a network (either hardwired, wireless, or a combination of hardwired and wireless) to a computer, the computer properly views the connection as a transmission medium. The furniture console 400 will include one or more communication channels that are used to communicate with the network 430. Transmissions media include a network that can be used to carry data or desired program code means in the form of computer-executable instructions or in the form of data structures. Further, these computer-executable instructions can be accessed by a general-purpose or special-purpose computer. Combinations of the above should also be included within the scope of computer-readable media.

The functionality and operation of the processor 412 can be performed, at least in part, by one or more hardware logic components (e.g., the processor(s) 412). For example, and without limitation, illustrative types of hardware logic components/processors that can be used include Field-Programmable Gate Arrays ("FPGA"), Program-Specific or Application-Specific Integrated Circuits ("ASIC"), Program-Specific Standard Products ("ASSP"), System-On-A-Chip Systems ("SOC"), Complex Programmable Logic Devices ("CPLD"), Central Processing Units ("CPU"), Graphical Processing Units ("GPU"), or any other type of programmable hardware.

Storage 418, and/or memory 414, may be physical system memory, which may be volatile, non-volatile, or some combination of the two. The term "memory" may also be used herein to refer to non-volatile mass storage such as physical storage media. If the furniture console 10 is distributed, the processing, memory, and/or storage capability may be distributed as well.

Storage 418 and the memory 414 can include executable instructions to perform the various methods and processes described herein. The executable instructions represent instructions that are executable by the controller 410, or perhaps the processor(s) 412, of the furniture console 400 to perform the disclosed operations, such as those described herein.

The controller 410 can control the various operations and processes associated with the furniture console 400. For instance, the controller 410 can control the operation of the virtual assistant 450 so that data can pass through the I/O 442 to the network 430 so that the virtual assistant 450 can access information to respond to questions or commands the virtual assistant 450 receives through the microphone 452 (such as microphone 96) and provides responses or information through the speaker 454 (such a speaker 98). Additional controls for the virtual assistant 450 include such various controls within the control region 52 or associated with the control assembly 50; those additional controls are generally referred to as the interfaces 416.

The controller 410 can also control the operation of the lighting system 460 that provides illumination for a user (which can be one or more of the lighting devices 14 described herein). For instance, the controller 410 can control when the lighting system 460 turns on and off and the manner by which the battery 65 (FIG. 8L) is charged.

The controller 410 can also control how the furniture console 400 is powered or powers other devices. For instance, the controller 410 can control charging speed of the power supply 470 when the furniture console 400 is connected to mains power, or other power source 490, through the USB port 480. The controller 410 can also control powering, and charging of the power supply 470, through wireless charging using the power receiver 500 (such as the wireless charging receiver 150 (FIG. 14)) and the external transmitter or induction charger 510 (such as the induction charger 152 (FIG. 1)). Furthermore, the controller 410 can control charging of an external receiver 520, such as a cellular phone, tablet, etc. having a receiving coil complementary to the power transmitter or induction charger 530, such as the inductive charger 180 (FIG. 15).

In addition to the above, the controller 410 can control the operation of the heating/cooling system 540 which is switchable between cooling and heating modes to cool or heat a container (which can be the thermal energy transfer assembly 16 described herein) and the flow path actuator 550 (which can be the actuator 69 (FIG. 11C) to aid with cooling the components of the furniture console 400. The heating/cooling system 540 includes a heat transfer assembly 542 (such as the heat transfer structure 120 (FIG. 11C)) and a fan 544 (such as the fan 130 (FIG. 11C). The controller 410 uses temperature data and other data from at least one sensor 560 to control the manner by which the heat/cooling system 540 and the flow path actuator 550 operate to heat/cool a container and heat/cool the furniture console 400 as a whole. The sensor(s) 560 can include, in one configuration, sensors associated with the electricity storage assembly 64 (FIG. 4), the heat sink 126 (FIG. 11C), the controller 410 itself, and any of the other electrical components or structures of the furniture console 400. The sensor(s) 560 can each have two predetermined limits, although more predetermined limits are also possible. In the illustrated configuration, a lower limit that can be used to initiate operation of the fan 130, while an upper limit can be used to initiate turning off of operational features or functions. When the sensor 560 detects a temperature that is below both thresholds, no data or signal need be passed to the controller 410. When the detected temperature is above the lower threshold, the sensor 560 sends data or a signal to the controller 410 indicating that the lower threshold has been passed and/or or requesting turning the fan 130 on. For instance, the sensor 560 can initiate a change in the operational state of the fan 130, i.e., to turn on the fan 130, or the sensor 560 can send a threshold passage warning signal that the controller 410 receives and then the controller 410 initiates the operational state change of the fan 130, i.e., the controller 410 turns on the fan 130. Similarly, when the detected temperature is above the higher threshold, the sensor 560 sends data or a signal to the controller 410 indicating that the higher threshold has been passed and/or or requesting deactivating of operational features or functions of the furniture console 410. For instance, the sensor 560 can initiate a change in the operational state of the operational features or functions of the furniture console 410 or the sensor 560 can send a threshold passage warning signal that the controller 410 receives and then the controller 410 initiates the operational state change of operational features or functions of the furniture console 410.

In another configuration, the limits that result in turning on the fan or turning off operational features or functions can be stored in the storage 418 and the controller 410 can compare the data received from the sensor(s) 560 with the threshold limits stored in the storage 418, such as using a look-up table or other data structure, and determined if the threshold(s) have been met. When a sensor threshold has been passed, the controller 410 can initiate performance of a particular operation, such as turning on the fan or turning off operational features or functions.

Figure 21:
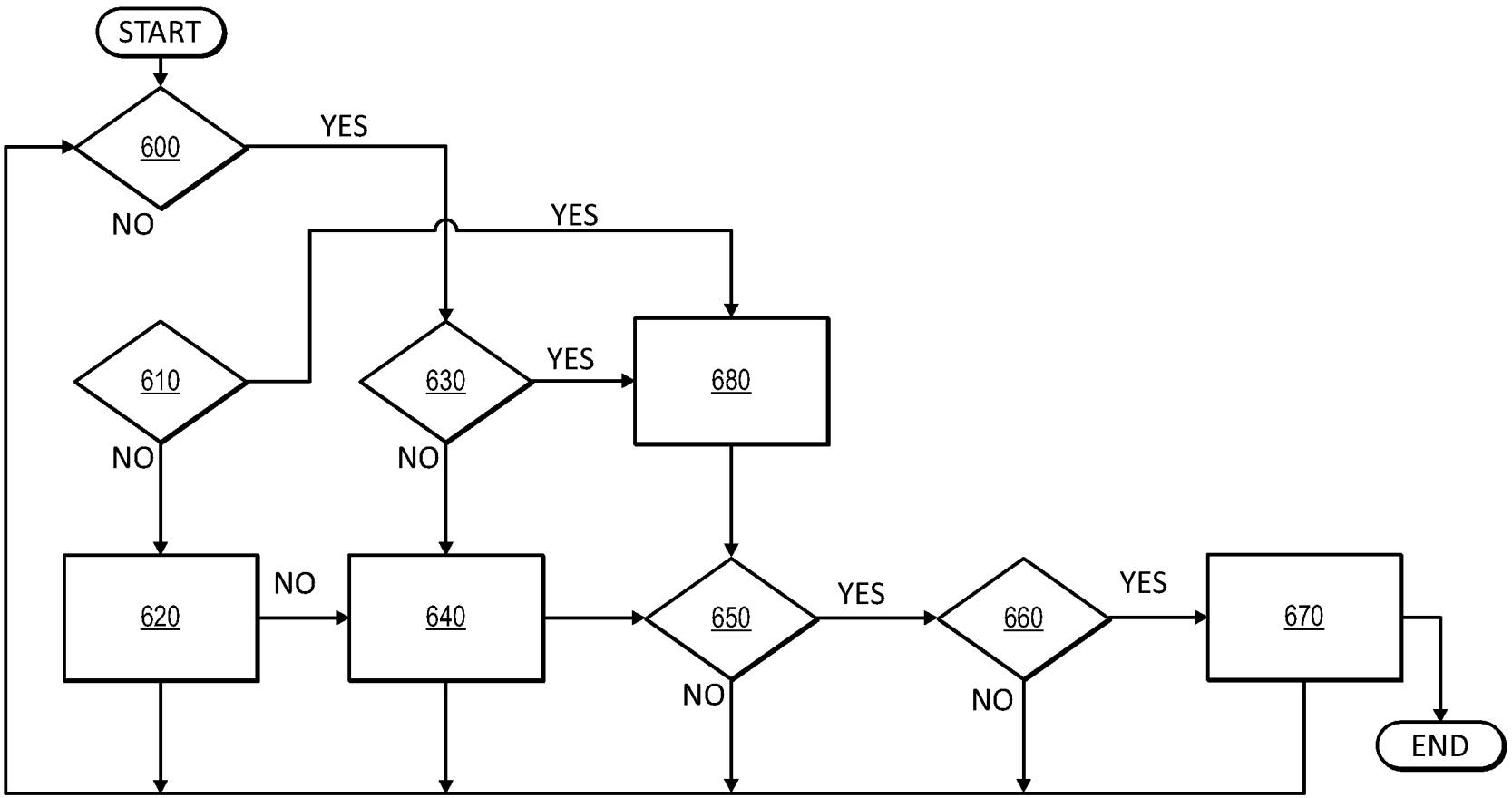
FIG. 21 is a flow diagram representing an operation of a controller of a furniture console.

Turning to FIGS. 20 and 21, an operation of the controller 410 with the heat/cooling system 540 and the flow path actuator 550 (which can be the actuator 69 (FIG. 11C) is schematically illustrated. The process can include determining whether or not the heating/cooling system 540 (thermal energy transfer assembly 16) is operational, at 600. When the heating/cooling system 540 (thermal energy transfer assembly 16) is not operational, sensor information is collected and it is determined if a temperature form the sensor (s) 560 are above a lower limit, at 610. When the temperature is below the lower limit, the fan remains turned off or is turned off when the fan was previously turned on, at 620.

In contrast, if it is determined at 600 that the heating/cooling system 540 (thermal energy transfer assembly 16) is operational, it is next determined, at 630, if the heat sink 126 is above a lower limit temperature. When the temperature is below the lower limit, the fan 130 is turned on and the flow path actuator 550 is operated to direct air toward the electricity storage assembly 64, at 640 and as illustrated in FIG. 11D. For instance, the flow path actuator 550 moves the diverter 68 to the flat orientation to direct warm air toward the electricity storage assembly 64. Thereafter, it is determined, at 650, if the temperature is above the upper limit threshold. If the temperature is below the threshold limit, the process returns to determining whether or not the heating/cooling system 540 (thermal energy transfer assembly 16) is operational, at 600. If the temperature is above the threshold, it is determined, at 660, if the fan 130 has been operating for longer than a specified or predetermined length of time. When the fan 130 has been operating for a shorter time than a specified or predetermined length of time, then the process returns to determining whether or not the heating/cooling system 540 (thermal energy transfer assembly 16) is operational, at 600. However, if the fan 130 has been operating for a longer time than the specified or predetermined length of time, at 660, a time for the fan 130 is reset and the next feature in a hierarchical list of features is deactivated or turned off to allow for cooling of the furniture console 400, at 670. The process can then either end or the process can return to determining whether or not the heating/cooling system 540 (thermal energy transfer assembly 16) is operational, at 600. The stored hierarchical list can include turning off: (i) battery charging, if the battery charge level is above a threshold level, or the thermal energy transfer assembly, (ii) wireless charging using the power receiver 500 (inductive charger 180), (iii) use of the virtual assistant 450 (integrated assistant control 94), (iv) the lighting system 460 (lighting device 14), (v) the USB ports 480 (USB ports 140).

Returning to 610, if it is determined that a temperature of a sensor is above the lower limit, at 680, the fan 130 is turned on and the flow path actuator 550 is operated to direct air away from the electricity storage assembly 64, such as illustrated in FIG. 11C. For instance, the flow path actuator 550 moves the diverter 68 to extend upwardly to direct warm air away from the electricity storage assembly 64. Thereafter the process again determines, at 650, if the temperature is above the upper limit threshold. If the temperature is below the threshold limit, the process returns to determining whether or not the heating/cooling system 540 (thermal energy transfer assembly 16) is operational, at 600. If the temperature is above the threshold, it is determined, at 660, if the fan 130 has been operating for longer than a specified or predetermined length of time. When the fan 130 has been operating for a shorter time than a specified or predetermined length of time, then the process returns to determining whether or not the heating/cooling system 540 (thermal energy transfer assembly 16) is operational, at 600. However, if the fan 130 has been operating for a longer time than the specified or predetermined length of time, at 670, the time for the fan 130 is reset and the next feature in a hierarchical list of features is deactivated or turned off to allow for cooling of the furniture console 400. The process then returns to determining whether or not the heating/cooling system 540 (thermal energy transfer assembly 16) is operational, at 600.

Returning to FIG. 20, the controller 410 may be implemented as a specific processing unit (e.g., a dedicated processing unit as described earlier) configured to perform one or more specialized operations for the furniture console 400. As used herein, the terms "executable module," "executable component," "component," "module," or "engine" can refer to hardware processing units or to software objects, routines, or methods that may be executed on the furniture console 10. The different components, modules, engines, and services described herein may be implemented as objects or processors that execute on the furniture console 10 (e.g., as separate threads). The controller 410 (or perhaps even just the processor(s) 412) can be configured to perform any of the disclosed method acts or other functionalities.

The disclosed embodiments may comprise or utilize a special-purpose or general-purpose computer including computer hardware, such as, for example, one or more processors (such as processor(s) 412) and system memory (such as storage 418 and/or member 414), as discussed in greater detail below. Embodiments also include physical and other computer-readable media for carrying or storing computer-executable instructions and/or data structures. Such computer-readable media can be any available media that can be accessed by a general-purpose or special-purpose computer system. Computer-readable media that store computer-executable instructions in the form of data are "physical computer storage media" or a "hardware storage device." Computer-readable media that carry computer-executable instructions are "transmission media." Thus, by way of example and not limitation, the current embodiments can comprise at least two distinctly different kinds of computer-readable media: computer storage media and transmission media.

Computer storage media (aka "hardware storage device") are computer-readable hardware storage devices, such as RAM, ROM, EEPROM, CD-ROM, solid state drives ("SSD") that are based on RAM, Flash memory, phase-change memory ("PCM"), or other types of memory, or other optical disk storage, magnetic disk storage or other magnetic storage devices, or any other medium that can be used to store desired program code means in the form of computer-executable instructions, data, or data structures and that can be accessed by a general-purpose or special-purpose computer.

Upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a network interface card or "NIC") and then eventually transferred to computer system RAM and/or to less volatile computer storage media at a computer system. Thus, it should be understood that computer storage media can be included in computer system components that also (or even primarily) utilize transmission media.

Computer-executable (or computer-interpretable) instructions comprise, for example, instructions that cause a general-purpose computer, special-purpose computer, or special-purpose processing device to perform a certain function or group of functions. The computer-executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the embodiments may be practiced in network computing environments with many types of computer system configurations, including personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The embodiments may also be practiced in distributed system environments where local and remote computer systems that are linked (either by hardwired data links, wireless data links, or by a combination of hardwired and wireless data links) through a network each perform tasks (e.g., cloud computing, cloud services and the like). In a distributed system environment, program modules may be located in both local and remote memory storage devices.

Figure 22:
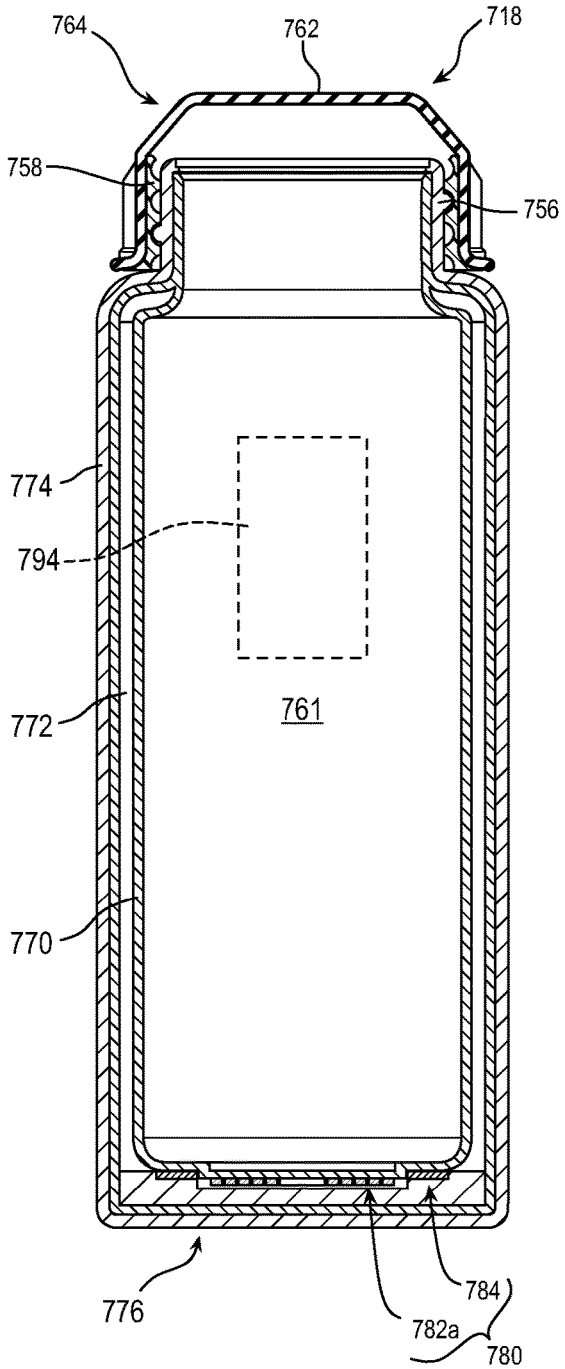
FIG. 22 is a cross-sectional view of a container.

As mentioned previously, the container 18 (FIG. 1) can be used with the thermal energy transfer assembly 16 to heat or cool the container 18 (FIG. 1). FIG. 22 illustrates an alternate container 718 that can be used with the thermal energy transfer assembly 16 or a separate inductive charger 152 (FIG. 1) or some other inductive charger, whether or not inductive charger is associated with a furniture assembly. The container 718, generally speaking, is a vacuum insulated flask with onboard circuitry, and optional associated software, and induction coil for heating the fluid contained within the container 718. Once the container 718 is in operational engagement with an induction charger, such as induction charger 152, the induction coil included or embedded in the container 718 can increase in temperature to heat the fluid.

Figure 23:
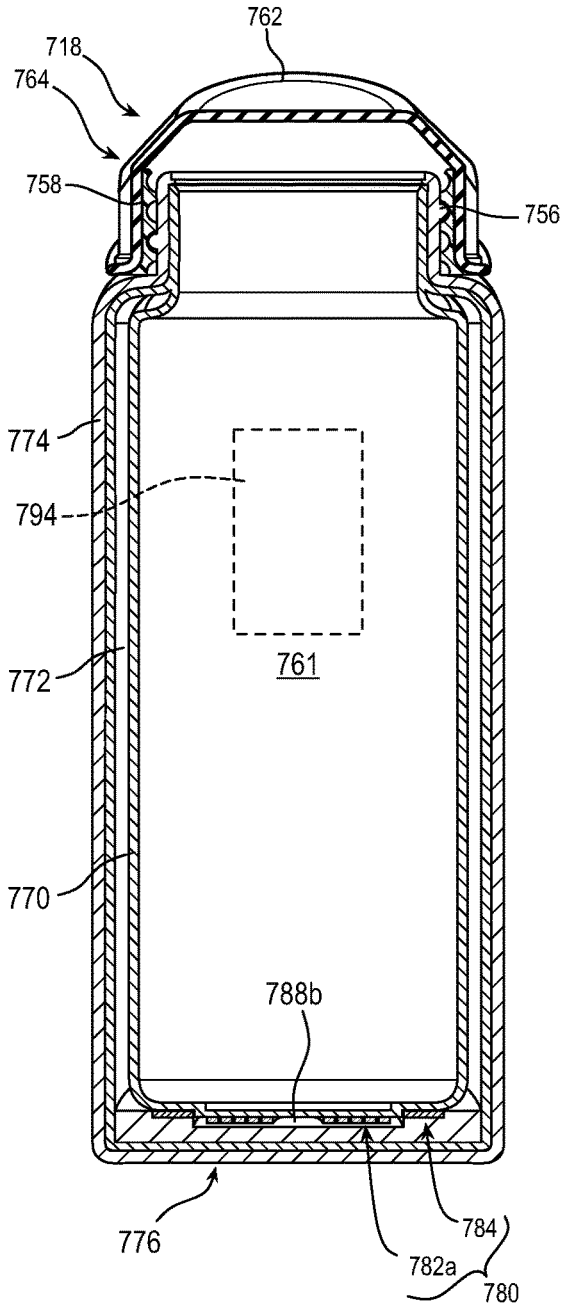
FIG. 23 is a cross-sectional view of a container.

As illustrated in FIGS. 22-23, the container 518 includes a body 760, a lid 762 that mounts to a first end 764 of the body 760, such as via complementary threads 766 and 768 formed, respectively, on the first end 764 of the body 760 and the lid 762. Alternative, the lid 762 can frictionally or by interference engage with the first end 764 to retain the lid 762 to the body 760. More generally, the lid 762 and the first end 764 have complementary structures to allow the lid 762 and the body 760 to releasably couple together.

To aid with heating, the container 718 can include an inner wall 770, an outer wall 774, and an insulative layer 772 at least partially disposed between the inner wall 770 and the outer wall 772. The insulative layer 772 extends from the first end 764 of the container 718 towards a bottom end 776. Disposed towards the bottom end 776 is a heating assembly 780 that can include a receiver coil 782*a* or receiver col 782*b* and a container controller 784, such as a printed circuit board (PCB) having one or more hardware and software components and modules to perform the functions described herein. The receiver coils 782*a* and 782*b* can insulated from a terminal end of the bottom end 776 by the insulative layer 772 to isolate the receiver coil 782*a* or 782*b* from a user and prevent burning when the receiver coil 782*a* and 782*b* receives energy from an inductive charger by electromagnetic induction. The receiver coil 782*b* includes a central opening 788*b*, while the receiver coil 782*a* includes no central opening.

Figure 24:
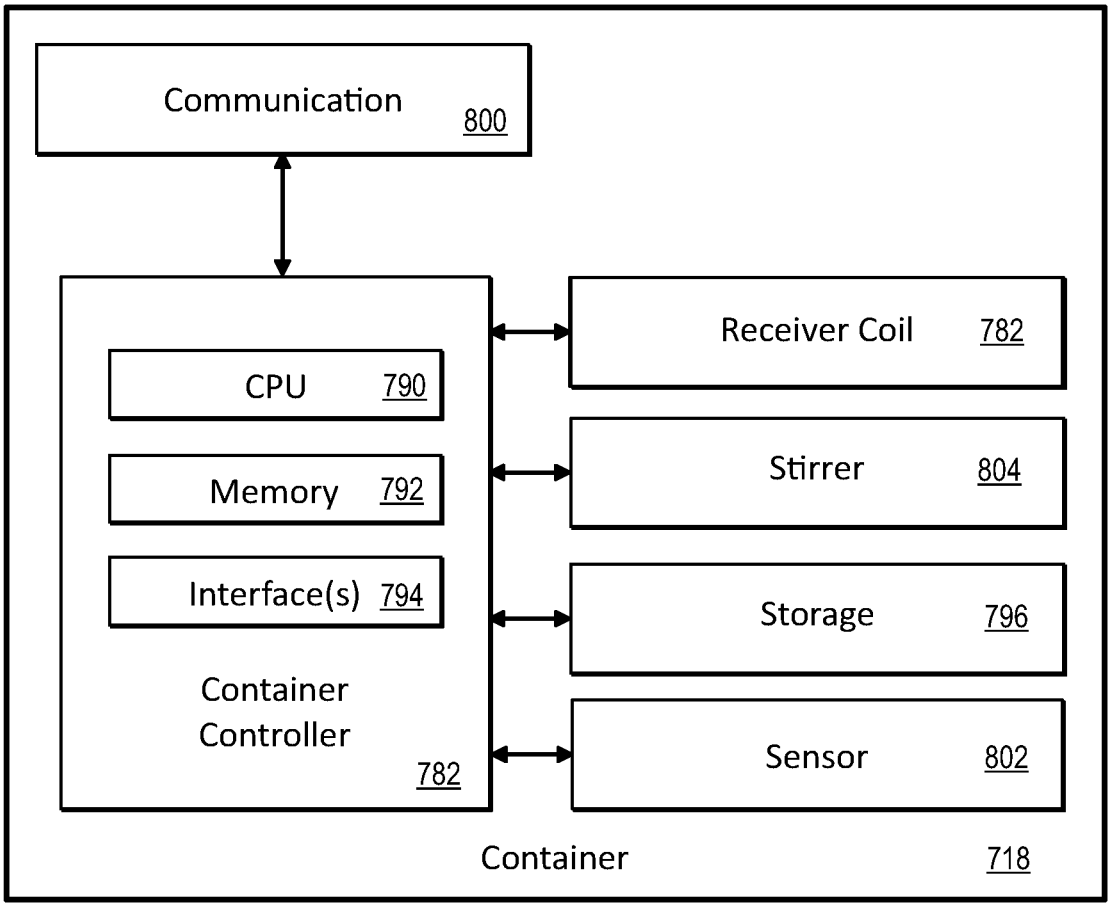
FIG. 24 is schematic representation of a container and controller associated with the container.

FIG. 24 illustrates a schematic representation of the container controller 784 and its communication with other components or structures of the container 518. As illustrated, the container controller 782 includes a processor 790, memory 792, interfaces 794 and can communicate with a storage 796. The controller 782, can have similar structures and functional modules to the controller 410 described herein. As such, the disclosure related to functional modules, components, structure, operations, processes, and methods related to the furniture console 400 are also applicable to the container 718.

The controller 782 controls the operation of the receiver coil 782 so that when the container 718 is brought within an operational distance of an inductive charger, such as inductive charger 152 (FIG. 1), the controller 782 controls the heat generated by the receiver coil 782 and so the heating of the container 718. For instance, the controller 782 can communicate with a device, such as a smart device or a remote control, through wireless communication interface 800, such as Bluetooth, Radio Frequency (RF), or other wireless communication modality, or communicate with the interfaces or controls 794 onboard the container 718 (whether wirelessly or through a wired connection), to allow a user to change or set a desired temperature for the liquid within the container 718. Based upon receiving temperature information from a sensor 802, the container controller 782 can cause the receiver coil 782 to increase or decrease in temperature. This can include, optionally, controlling a stirrer 804 disposed within the liquid chamber 761 of the container 718 to circulate the liquid. The stirrer 804 can include a motor disposed within the container 718 and powered by the inductive charger 152, for instance, or the stirrer 804 can be agitated by the magnetic field associated with the being powered by the inductive charger 152.

When the desired temperature is achieved, the container controller 782 can notify the user through the interfaces 794, such as an audio notification, a visual notification (such as illuminating an LED), combination of audio and visual notification on the container 718 and/or a notification through the connected smart device or remote control, such as audio notification, a visual notification, or some other notification.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant work of drywall repair.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

Following are some further example implementations or configurations of the invention. These are presented only by way of example and are not intended to limit the scope of the invention in any way. Further, any example implementation or configuration can be combined with one or more of the example implementations or configurations.

Configuration 1. A furniture console including a base; at least one of: a lighting device selectively mounted to the base; a first charging device supported by the base; a thermal energy transfer assembly configured to heat or cool a first container selectively mounted to the base; and an electricity storage assembly mounted within the base, the electricity storage assembly being configured to power the furniture console. The furniture console includes a control assembly configured to control operation of the at least one of the lighting device, the first charging device, and the thermal energy transfer assembly; and at least one air flow path extending through at least a portion of base to direct air past the thermal energy transfer assembly to aid with transfer of energy between the thermal energy transfer assembly and the air.

Configuration 2. The furniture console of configuration 1, wherein the at least one air flow path includes at least one baffle to selectively direct air flow.

Configuration 3. The furniture console of any of configurations 1-2, wherein the at least one air flow path includes at least one adjustable diverter.

Configuration 4. The furniture console of any of configurations 1-3, wherein the lighting device is selectively disposed within a channel formed in the base.

Configuration 5. The furniture console of any of configurations 1-4, wherein the channel is formed internally of the base.

Configuration 6. The furniture console of any of configurations 1-5, wherein a first leg portion of the base extends in a first direction from an intermediate portion of the base, the first leg portion includes a channel formed internally of the first leg portion.

Configuration 7. The furniture console of any of configurations 1-6, wherein a first leg portion of the base extends in a first direction from an intermediate portion of the base, the first leg portion includes a channel extending transversely to the first direction.

Configuration 8. The furniture console of any of configurations 1-7, wherein the control assembly includes at least one controller accessible via one of a first leg portion of the base, a second leg portion of the base, and an intermediate portion of the base.

Configuration 9. The furniture console of any of configurations 1-8, wherein the control assembly includes at least one control selectable to switch the electricity storage assembly between a heating mode and a cooling mode.

Configuration 10. The furniture console of any of configurations 1-9, wherein the electricity storage assembly includes at least one heat sink.

Configuration 11. The furniture console of any of configurations 1-10, further including a second charging device.

Configuration 12. The furniture console of any of configurations 1-11, wherein the first charging device and the second charging device are wireless chargers.

Configuration 13. The furniture console of any of configurations 1-12, wherein the furniture console is selectively mounted to furniture.

Configuration 14. The furniture console of any of configurations 1-13, wherein the furniture console is mounted to an arm or back of the furniture.

Configuration 15. A furniture console including a base including a first leg portion, a second leg portion, and an intermediate portion; at least one of: a lighting device selectively mounted to the base; a first charging device supported by the base; a thermal energy transfer assembly cooperating with a recess of the base, the thermal energy transfer assembly being configured to heat or cool a first container selectively mounted within at least a portion of the recess; a virtual assistant; and a battery mounted within at least one of the first leg portion and the intermediate portion, the battery being configured to power the furniture console. The furniture console includes a control assembly configured to control operation of the at least one of the lighting device, the first charging device, and the thermal energy transfer assembly; and at least one air flow path extending through at least a portion of one or more of the first leg portion, the second leg portion, and the intermediate portion to direct air past the thermal energy transfer assembly to aid with transfer of energy between the thermal energy transfer assembly and the air.

Configuration 16. The furniture console of configuration 15, wherein the lighting device is configured to telescope and be received, at least partially, within a portion of the base.

Configuration 17. The furniture console of any of configurations 15-16, wherein the lighting device is configured to fold and be received, at least partially, within a portion of the base.

Configuration 18. The furniture console of any of configurations 15-17, wherein the base includes an adjustable plate to change a dimension between the first leg portion and the second leg portion.

Configuration 19 The furniture console of any of configurations 15-18, wherein the second leg portion telescopically engages with the first leg portion.

Configuration 20. The furniture console of any of configurations 15-19, wherein the lighting device electrically engages with a portion of the base.

Configuration 21. The furniture console of any of configurations 15-20, wherein the lighting device includes electrically contacts that selectively electrically engage with a portion of the base.

Configuration 22. The furniture console of any of configurations 15-21, wherein the lighting device is selectively detachable from the base.

Configuration 23. The furniture console of any of configurations 15-22, wherein the thermal energy transfer assembly includes a Peltier plate.

Configuration 24. The furniture console of any of configurations 15-23, further including a controller to control the operation of at least one of the lighting device, the first charging device, and the thermal energy transfer assembly.

Configuration 25. The furniture console of any of configurations 15-24, wherein the controller is configured to control an actuator to operate a diverter to change a flow path for air flowing toward the battery.

Configuration 26. The furniture console of any of configurations 15-25, wherein the first charging device is an inductive charger and is controlled by the controller.

Configuration 27. The furniture console of any of configurations 15-26, further including a second charging device.

Configuration 28. A furniture system including a first furniture assembly including a seat portion, and arm portion, and a back portion; and a furniture console selectively mounted to the first furniture assembly, the furniture console being selectively mounted to one of the arm portion and the back portion.

Configuration 29. The furniture system of configuration 28, wherein the furniture console includes a furniture console from any of configurations 1-27.

Configuration 30. The furniture system of any of configurations 28-29, wherein the first furniture assembly includes a modular furniture assembly.

Configuration 31. The furniture system of any of configurations 28-30, wherein the first furniture assembly includes at least one inductive charger.

Configuration 32. The furniture system of any of configurations 28-31, wherein the first furniture assembly includes an integral electrical hub.

Configuration 33. The furniture system of any of configurations 28-32, wherein the first furniture assembly is electrically coupled to a power source.

Configuration 34. A container including an outer wall; an insulative layer; an inner wall forming an interior liquid chamber; and a heating assembly configured to heat the inner wall and liquid disposed in the interior liquid chamber.

Configuration 35. The container of configuration 34, wherein the heating assembly includes at least one receiver coil of an inductive charger.

Configuration 36. The container of any of configurations 34-35, further including a container controller configured to control the operation of the inductive charger.

Configuration 37. The container of any of configurations 34-36, further including an interface mounted to the outer wall of the container.

Configuration 38. The container of any of configurations 34-37, further including a stirrer disposed within the interior liquid chamber and operationally connected to the container controller.

Configuration 39. The container of any of configurations 34-38, wherein the container controller includes a printed circuit board.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A furniture console comprising:

a base;

at least one of:

a lighting device selectively mounted to the base;

a first charging device supported by the base;

a thermal energy transfer assembly configured to heat or cool a first container selectively mounted to the base; and an electricity storage assembly mounted within the base, the electricity storage assembly being configured to power the furniture console;

a control assembly configured to control operation of the at least one of the lighting device, the first charging device, and the thermal energy transfer assembly; and at least one air flow path extending through at least a portion of base to direct air past the thermal energy transfer assembly to aid with transfer of energy between the thermal energy transfer assembly and the air.

2. The furniture console of claim 1, wherein the at least one air flow path comprises at least one baffle to selectively direct air flow, or at least one adjustable diverter.

3. The furniture console of claim 1, wherein the lighting device is selectively disposed within a channel formed in the base, wherein the channel is formed internally of the base.

4. The furniture console of claim 3, wherein a first leg portion of the base extends in a first direction from an intermediate portion of the base, and at least one of:

the first leg portion comprises a channel formed internally of the first leg portion; or the first leg portion comprises a channel extending transversely to the first direction.

5. The furniture console of claim 1, wherein the control assembly comprises at least one controller accessible via one of a first leg portion of the base, a second leg portion of the base, or an intermediate portion of the base.

6. The furniture console of claim 1, wherein the control assembly comprises at least one control selectable to switch the electricity storage assembly between a heating mode and a cooling mode.

7. The furniture console of claim 1, wherein the electricity storage assembly comprises at least one heat sink.

8. The furniture console of claim 1, further comprising a second charging device, wherein the first charging device and the second charging device are wireless chargers.

9. The furniture console of claim 1, wherein the furniture console is selectively mounted to an arm or back of the furniture.

10. A furniture console comprising:

a base comprising a first leg portion, a second leg portion, and an intermediate portion;

at least one of:

a lighting device selectively mounted to the base;

a first charging device supported by the base;

a thermal energy transfer assembly cooperating with a recess of the base, the thermal energy transfer assembly being configured to heat or cool a first container selectively mounted within at least a portion of the recess;

a virtual assistant; and a battery mounted within at least one of the first leg portion and the intermediate portion, the battery being configured to power the furniture console; and a control assembly configured to control operation of the at least one of the lighting device, the first charging device, and the thermal energy transfer assembly; and at least one air flow path extending through at least a portion of one or more of the first leg portion, the second leg portion, and the intermediate portion to direct air past the thermal energy transfer assembly to aid with transfer of energy between the thermal energy transfer assembly and the air.

11. The furniture console of claim 10, wherein the lighting device is (i) configured to telescope and be received, at least partially, within a portion of the base or (ii) configured to fold and be received, at least partially, within a portion of the base.

12. The furniture console of claim 10, wherein the base comprises an adjustable plate to change a dimension between the first leg portion and the second leg portion.

13. The furniture console of claim 10, wherein the second leg portion telescopically engages with the first leg portion.

14. The furniture console of claim 10, wherein the lighting device electrically engages with a portion of the base, wherein the lighting device comprises electrical contacts that selectively electrically engage with a portion of the base.

15. The furniture console of claim 10, wherein the thermal energy transfer assembly comprises a Peltier plate.

16. The furniture console of claim 10, further comprising a controller to control the operation of at least one of the lighting device, the first charging device, or the thermal energy transfer assembly.

17. The furniture console of claim 16, wherein the controller is configured to control an actuator to operate a diverter to change a flow path for air flowing toward the battery.

18. The furniture console of claim 16, wherein the first charging device is an inductive charger and is controlled by the controller.

19. A furniture system comprising:

a first furniture assembly comprising a seat portion, an arm portion, and a back portion wherein the first furniture assembly comprises at least one inductive charger embedded in the arm portion or in the back portion of the first furniture assembly; and a furniture console selectively mounted to the first furniture assembly, the furniture console being selectively mounted to one of the arm portion or the back portion, over the at least one inductive charger, so as to receive and store power therefrom for powering one or more features of the furniture console, wherein the furniture console comprises:

a base;

at least one of:

a lighting device selectively mounted to the base;

a first charging device supported by the base;

a thermal energy transfer assembly configured to heat or cool a first container selectively mounted to the base; and an electricity storage assembly mounted within the base, the electricity storage assembly being configured to power the furniture console;

a control assembly configured to control operation of the at least one of the lighting device, the first charging device, and the thermal energy transfer assembly; and at least one air flow path extending through at least a portion of base to direct air past at least one of the thermal energy transfer assembly, to aid with transfer of energy between the thermal energy transfer assembly and the air, and the electricity storage assembly.

20. The furniture system of claim 19, wherein the first furniture assembly comprises a modular furniture assembly.

21. The furniture system of claim 19, wherein the first furniture assembly is electrically coupled to a power source.

22. A furniture system, wherein the furniture system comprises the furniture console of claim 1.

* * * * *